US010971806B2

(12) United States Patent
Rogers et al.

(10) Patent No.: US 10,971,806 B2
(45) Date of Patent: Apr. 6, 2021

(54) BROADBAND CONFORMAL ANTENNA

(71) Applicant: The Boeing Company, Chicago, IL (US)

(72) Inventors: John E. Rogers, Owens Cross Roads, AL (US); Larry Leon Savage, Huntsville, AL (US); John Dalton Williams, Decatur, AL (US); Ted Ronald Dabrowski, Madison, AL (US)

(73) Assignee: THE BOEING COMPANY, Chicago, IL (US)

( * ) Notice: Subject to any disclaimer, the term of this patent is extended or adjusted under 35 U.S.C. 154(b) by 325 days.

(21) Appl. No.: 15/683,718

(22) Filed: Aug. 22, 2017

(65) Prior Publication Data

US 2019/0067805 A1 Feb. 28, 2019

(51) Int. Cl.

| | |
|---|---|
| ***H01Q 1/28*** | (2006.01) |
| ***H01Q 13/08*** | (2006.01) |
| ***H01Q 9/28*** | (2006.01) |
| ***H01Q 21/26*** | (2006.01) |
| ***H01Q 13/22*** | (2006.01) |
| ***H01Q 21/00*** | (2006.01) |

(52) U.S. Cl.

CPC ..... *H01Q 1/286* (2013.01); *H01Q 9/28* (2013.01); *H01Q 13/085* (2013.01); *H01Q 13/22* (2013.01); *H01Q 21/005* (2013.01); *H01Q 21/26* (2013.01)

(58) Field of Classification Search

CPC ..... H01Q 1/28; H01Q 13/08–13/10; H01Q 13/22; H01Q 21/0043; H01Q 21/005

See application file for complete search history.

(56) References Cited

U.S. PATENT DOCUMENTS

| | | | | |
|---|---|---|---|---|
| 2,677,766 A | | 5/1954 | Litchford | |
| 3,404,405 A | | 10/1968 | Young | |
| 3,665,480 A | | 5/1972 | Fassett | |
| 3,696,433 A | * | 10/1972 | Killion | H01Q 13/10 343/770 |
| 3,729,740 A | | 4/1973 | Nakahara et al. | |

(Continued)

FOREIGN PATENT DOCUMENTS

| | | |
|---|---|---|
| CN | 105846051 A | 8/2016 |
| EP | 2573872 A1 | 3/2013 |

(Continued)

OTHER PUBLICATIONS

Jackson, D.R., Caloz, C., et al., "Leaky-wave antennas," Proceedings of the IEEE, Jul. 2012.

(Continued)

*Primary Examiner* — Hasan Z Islam

(74) *Attorney, Agent, or Firm* — Moore Intellectual Property Law, PLLC

(57) ABSTRACT

A broadband conformal antenna ("BCA") is disclosed. The BCA includes a narrow approximately rectangular outer conductive ("NARO") housing, a plurality of dielectric layers within the NARO housing forming a laminated dielectric structure, and an inner conductor formed within the laminated dielectric structure. The NARO housing includes a top broad wall and the BCA further includes an antenna slot within the top broad wall. The BCA is configured to support a transverse electromagnetic signal within the NARO housing.

33 Claims, 21 Drawing Sheets

(56) References Cited

U.S. PATENT DOCUMENTS 4,197,545 A 4/1980 Favaloro et al.
4,232,321 A 11/1980 Ohm
4,313,120 A * 1/1982 Westerman ..... H01O 21/0043 343/770
4,835,538 A 5/1989 McKenna et al.
4,862,185 A 8/1989 Andrews et al.
5,043,738 A 8/1991 Shapiro et al.
5,218,322 A 6/1993 Allison et al.
5,353,035 A 10/1994 Cuervo-Arango et al.
5,421,848 A 6/1995 Maier et al.
5,473,336 A 12/1995 Harman et al.
5,581,267 A 12/1996 Matsui et al.
5,726,666 A * 3/1998 Hoover ..... H01Q 13/10 343/767
5,914,693 A * 6/1999 Takei ..... H01Q 13/16 343/700 MS
5,977,710 A 11/1999 Kuramoto et al.
5,977,924 A * 11/1999 Takei ..... H01Q 21/068 343/700 MS
5,982,256 A * 11/1999 Uchimura ..... H01P 1/047 333/239
6,005,520 A 12/1999 Nalbandian et al.
6,198,453 B1 * 3/2001 Chew ..... H01Q 13/10 343/767
6,252,549 B1 6/2001 Derneryd
6,285,325 B1 9/2001 Nalbandian et al.
6,593,887 B2 7/2003 Luk et al.
6,646,609 B2 11/2003 Yuasa et al.
6,664,931 B1 * 12/2003 Nguyen ..... H01Q 1/243 343/700 MS
7,385,462 B1 6/2008 Epp et al.
7,471,248 B2 12/2008 Popugaev et al.
7,471,258 B2 12/2008 Hsu et al.
8,197,473 B2 6/2012 Rossetto et al.
8,384,499 B2 * 2/2013 Suzuki ..... H01Q 13/203 333/237
8,665,142 B2 * 3/2014 Shijo ..... H01Q 21/064 342/175
8,860,532 B2 10/2014 Gong et al.
9,437,184 B1 9/2016 Swett
9,496,613 B2 11/2016 Sawa
9,979,459 B2 5/2018 Savage et al.
10,283,832 B1 5/2019 Chayat et al.
10,291,312 B2 5/2019 Savage et al.
10,522,916 B2 12/2019 Rogers et al.
10,777,905 B2 9/2020 Diehl et al.
2002/0047803 A1 4/2002 Ishitobi et al.
2003/0006941 A1 1/2003 Ebling et al.
2003/0043086 A1 3/2003 Schaffner et al.
2003/0103006 A1 6/2003 Yamada
2004/0104852 A1 6/2004 Choi et al.
2004/0196203 A1 10/2004 Lier et al.
2006/0001574 A1 1/2006 Petros
2006/0044188 A1 3/2006 Tsai et al.
2006/0098272 A1 5/2006 Lerner et al.
2007/0216596 A1 9/2007 Lewis et al.
2007/0279143 A1 12/2007 Itsuji
2008/0136553 A1 6/2008 Choi et al.
2008/0252544 A1 10/2008 Irion et al.
2009/0046029 A1 2/2009 Nagai
2009/0289858 A1 11/2009 Olsson
2010/0001916 A1 * 1/2010 Yamaguchi ..... H01Q 21/005 343/771
2010/0181379 A1 7/2010 Okegawa et al.
2010/0245155 A1 9/2010 Miyazato et al.
2011/0062234 A1 3/2011 Oishi
2011/0090129 A1 4/2011 Weily et al.
2011/0165839 A1 7/2011 Kawamura et al.
2012/0276856 A1 11/2012 Joshi et al.
2012/0287019 A1 11/2012 Sudo et al.
2012/0299783 A1 11/2012 Lee et al.
2013/0063310 A1 3/2013 Mak et al.
2013/0258490 A1 10/2013 Ishihara
2013/0278467 A1 10/2013 Dassano et al.
2014/0110841 A1 4/2014 Beer et al.
2014/0168014 A1 6/2014 Chih et al.
2014/0354411 A1 12/2014 Pudenz
2015/0249283 A1 9/2015 Watanabe et al.
2015/0364823 A1 12/2015 Hashimoto et al.
2016/0056541 A1 2/2016 Tageman et al.
2016/0056544 A1 2/2016 Garcia et al.
2016/0126617 A1 5/2016 Jan et al.
2016/0126637 A1 * 5/2016 Uemichi ..... H01O 21/0043 343/771
2016/0190696 A1 6/2016 Preradovic et al.
2016/0190697 A1 6/2016 Preradovic et al.
2016/0218420 A1 7/2016 Leung et al.
2016/0261036 A1 9/2016 Sato et al.
2016/0294045 A1 10/2016 Shiu et al.
2016/0295335 A1 10/2016 Vajha et al.
2016/0322703 A1 11/2016 Jesme et al.
2017/0084971 A1 3/2017 Kildal et al.
2017/0133756 A1 5/2017 Eastburg et al.
2019/0067805 A1 2/2019 Rogers et al.
2019/0086581 A1 3/2019 Diehl et al.
2019/0237844 A1 8/2019 Rogers et al.
2019/0237876 A1 8/2019 Rogers et al.
2020/0067165 A1 2/2020 Rogers
2020/0067201 A1 2/2020 Rogers

FOREIGN PATENT DOCUMENTS

EP 2750246 A1 7/2014
EP 3012916 A1 4/2016
JP 2003283239 A 10/2003
KR 100449846 B1 9/2004
WO 20150102938 7/2015

OTHER PUBLICATIONS

Satoshi, Y., Tahara, Y., et al., "Inclined slot array antennas on a rectangular coaxial line," Proceedings of the 5th European Conference on Antennas and Propagation, 2011.
Kim, D.H., Eom, H.J., "Radiation of a leaky coaxial cable with narrow traverse slots," IEEE Transactions on Antennas and Propagation, Jan. 2007, pp. 107-110.
Abu Tarboush, H. F et al., "Bandwidth Enhancement for Microstrip Patch Antenna Using Stacked Patch and Slot", 2009 IEEE International Workshop on Antenna Technology, Mar. 2-4, 2009, 4 pgs.
Allen, J. W., et al., "Design and fabrication of an RF GRIN lens 3D printing technology", Proc. of SPIE, vol. 8624, Feb. 20, 2013, 8 pgs.
Ambresh P. A., et al., "Effect of Slots on Microstrip Patch Antenna Characteristics", International Conference on Computer, Communication and Electrical Technology—ICCCET2011, Mar. 18-19, 2011, pp. 239-241.
Cheng, Yu Jian, et al., "W-band Large-Scale High-Gain Planar Integrated Antenna Array," IEEE Transactions on Antennas and Propagation, vol. 62, No. 6, Jun. 2014, pp. 3370-3373.
Cook, Benjamin S. et al. "Multilayer Inkjet Printing of Millimeter-Wave Proximity-Fed Patch Arrays on Flexible Substrates", IEEE Antennas and Wireless Propagation Letters, vol. 12, 2013, pp. 1351-1354.
Davidowitz, Marat et al., "Rigorous Analysis of a Circular Patch Antenna Excited by a Microstrip Transmission Line", IEEE Transactions on Antennas and Propagation, vol. 37, No. 8, Aug. 1989, pp. 949-958.
Delgado, Guillermo et al., "Scanning Properties of Teflon Lenses," Microwave and Optical Technology Letters, vol. 11, No. 5, Apr. 5, 1996, pp. 271-273.
European Patent Office Extended Search Report, Application No. 17175267.8-1927, dated Oct. 19, 2017, pp. 1-8.
Extended European Search Report for Application No. 18189791.9 dated Feb. 18, 2019, pp. 1-8.
Gauthier, Gildas P. et al., "A 94-GHz Aperture-Coupled Micromachined Microstrip Antenna," IEEE Transactions on Antennas and Propagation, vol. 47, No. 12, Dec. 1999, pp. 1761-1766.
Grabherr, W. et al., "Microstrip to Waveguide Transition Compatible With mm-Wave Integrated Circuits," IEEE Transactions on Microwave Theory and Techniques, vol. 42, No. 9, Sep. 1994, pp. 1842-1843.

(56) References Cited

OTHER PUBLICATIONS

Iizuka, Hideo et al., "Millimeter-Wave Microstrip Line to Waveguide Transition Fabricated on a Single Layer Dielectric Substrate," R&D Review of Toyota CRDL, vol. 37, No. 2, Jun. 2002, pp. 13-18.
Iwaski, Hisao, "A Circularly Polarized Small-Size Microstrip Antenna with a Cross Slot", IEEE Transactions on Antennas and Propagation, vol. 44, No. 10, Oct. 1996, pp. 1399-1401.
Jain, Sidharath, et al., "Flat-Base Broadband Multibeam Luneburg Lens for Wide Angle Scan," Cornell University, May 4, 2013, arXiv.org > physics > arXiv:1305.0964, pp. 1-15.
Kaneda, Noriaki et al., "A Broad-band Microstrip-to-Waveguide Transition Using Quasi-Yagi Antenna," IEEE Transactions on Microwave Theory and Techniques, Dec. 1999, pp. 1-4.
Li, B. et al., "Study on High Gain Circular Waveguide Array Antenna with Metamaterial Structure," Progress in Electromagnetics Research (PIER), vol. 6, 2006, pp. 207-219.
Lin, Ting-Huei et al., "CPW to Waveguide Transition with Tapered Slotline Probe," IEEE Microwave and Wireless components Letters, vol. 11, No. 7, Jul. 2001, pp. 314-316.
Menzel, W. et al. "A microstrip patch antenna with coplanar feed line," IEEE Microwave and Guided Wave Letters, Nov. 1991, pp. 340-342.
Papapolymerou, Ioannis et al., "Micromachined Patch Antennas," IEEE Transactions on Antennas and Propagation, vol. 46, No. 2, Feb. 1998, pp. 275-283.
Ponchak, George E et al., "A New Rectangular Waveguide to Coplanar Waveguide Transition," IEEE MTT-S International Microwave Symposium, May 1990, pp. 1-4.
Pozar, D.M. et al., "Increasing the Bandwidth of a Microstrip Antenna by Proximity Coupling", Electronics Letters Apr. 9, 1987 vol. 23 No. 8, pp. 368-369.
Pozar, D.M., "Microstrip Antenna Aperture Coupled to a Microstripline", Electronics Letters Jan. 17, 1985 vol. 21 No. 2, pp. 49-50.
Pozar, David M. et al., "A Rigorous Analysis of a Microstripline Fed Patch Antenna", IEEE Transactions on Antennas and Propagation, vol. AP-35, No. 12, Dec. 1987, pp. 1343-1350.
Rida, Amin et al., "Proximity Coupled Fed Antenna Arrays on LCP for mm-Wave Applications," IEEE Antennas and Propagation Society International Symposium, Jul. 2010, pp. 1-4.
Schoenlinner, Bernhard, "Compact Wide Scan-Angle Antennas for Automotive Applications and RF MEMS Switchable Frequency-Selective Surfaces," A dissertation submitted in partial fulfillment of the requirements for the Degree of Doctor of Philosophy, The University of Michigan, 2004, pp. cover-172.
Schoenlinner, Bernhard, "Wide-Scan Spherical-Lens Antennas for Automotive Radars," IEEE Transactions on Microwave theory and Techniquest, vol. 50, No. 9, Sep. 2002, pp. 2166-2175.
Simon, W. et al., "A Novel Coplanar Transmission Line to Rectangular Waveguide Transition," IEEE MTT-S Digest, Jun. 1998, pp. 257-260.
Sorkherizi, Milad S. et al., "Planar High-efficiency Antenna Array Using New Printed Ridge Gap Waveguide Technology," IEEE Transactions on Antennas and Propogation, vol. 65, No. 7, Jul. 2017, pp. 3772-3776.
Targonski, S.D. et al., "Design of wideband circularly polarized aperture-coupled microstrip antennas," IEEE Transactions on Antennas and Propagation, Feb. 1993.
Tribe, J. et al., "Additively manufactured hetrogeneous substrates for three-dimensional control of permittivity," Electronics Letters, May 8, 2014, vol. 50, No. 10, pp. 745-746.
Wang, C., et al., "A novel CP patch antenna with a single feed structure," IEEE Antennas and Propagation Society International Symposium, Jul. 2000, pp. 1000-1003.
Wang, J., et al., "Multifunctional aperture coupled stack patch antenna," Electronics Letters, Dec. 1990, pp. 2067-2068.
Zhang, Guo-Hua, et al. "A Circular Waveguide Antenna Using High-Impedance Ground Plane," IEEE Antennas and Wireless Propagation Letters, vol. 2, 2003, pp. 86-88.
Zhang, S. et al., "3D-printed flat lens for microwave applications," presented at the Antennas and Propagation aonference (LAPC2015) Loughborough University, pp. 1-4.
Zurcher, J.F., "The SSFIP: a global concept for high-performance broadband patch antennas," Electronics Letters, Nov. 1988, pp. 1433-1435.

* cited by examiner

BROADBAND CONFORMAL ANTENNA

STATEMENT REGARDING FEDERALLY SPONSORED RESEARCH AND DEVELOPMENT

This invention was made with Government support under FHE-MII CONSORTIUM-DEVELOPMENT AGREEMENT-FAA awarded by the U.S. Air Force Research Laboratory ("AFRL"). The government has certain rights in the invention.

STATEMENT REGARDING FEDERALLY SPONSORED RESEARCH AND DEVELOPMENT

This invention was made with United States Government ("USG") support under Contract Number WA-17-01192 awarded by the Department of Defense, U.S. Air Force Research Laboratory ("AFRL"). The USG has certain rights in the invention.

BACKGROUND

1. Field

The present disclosure is related to antennas, and more specifically, to traveling-wave antennas.

2. Related Art

At present, there is a need for antennas that can conform to non-planar, curved surfaces such as aircraft fuselages and wings, ships, land vehicles, buildings, or cellular base stations. Furthermore, conformal antennas reduce radar cross section, aerodynamic drag, are low-profile, and have minimal visual intrusion.

Existing conformal antennas are generally implemented as a phased-array that includes a plurality of antenna elements such as, for example, dipole, horn, or patch antennas. These conformal antennas are typically complex, expensive, and integrated into the surface of an object to which they are designed to operate on. They are generally susceptible to the electromagnetic effects caused by the surfaces on which they are placed, especially if the surfaces are composed of metal (e.g., aluminum, steel, titanium, etc.) or carbon fiber, which is electrically conductive by nature. As such, to increase their electrical performance, these known types of conformal antennas need to be designed taking into account the shape and material of surface on which they will be placed and, as such, are not flexible for use across multiple types of surfaces, platforms, or uses.

Existing conformal antennas typically have a trade-off between the thickness of the antenna and the bandwidth. A thin antenna, for example, is more flexible, but has a narrower bandwidth. As such, there is a need for a new conformal antenna that address these issues.

SUMMARY

A broadband conformal antenna ("BCA") is disclosed. The BCA includes a narrow approximately rectangular outer conductive ("NARO") housing, a plurality of dielectric layers within the NARO housing forming a laminated dielectric structure, and an inner conductor formed within the laminated dielectric structure. The NARO housing includes a top broad wall and the BCA further includes an antenna slot within the top broad wall. The BCA is configured to support a transverse electromagnetic signal within the NARO housing.

Also disclosed is a method for fabricating the BCA utilizing a lamination process. The method includes patterning a first metal on a first dielectric layer having a top surface and a bottom surface and patterning a second metal on a second dielectric layer having a top surface and a bottom surface. The first metal is patterned on the bottom surface of first dielectric layer and the second metal is patterned on a portion of the top surface of the second dielectric layer, where the second metal is patterned on the second dielectric layer to produce an inner conductor. The method then laminates the bottom surface of the second dielectric layer on the top surface of the first dielectric layer and laminates a third dielectric layer, having a top surface and a bottom surface, on the top surface of the second dielectric layer, where the bottom surface of the third dielectric layer is laminated on to the top surface of the second dielectric layer. The method then patters a third metal on a fourth dielectric layer having a top surface and a bottom surface, where the third metal is patterned on the top surface of the fourth dielectric layer to produce a top broad wall and where the metal of the top broad wall is patterned to include an antenna slot along the top broad wall that exposes the top surface of the fourth dielectric layer through the metal of the top broad wall. The method then laminates the bottom surface of fourth dielectric layer on to the top surface of the third dielectric layer to produce a composite laminated structure, produces a first plurality of vias through a first side of the composite laminated structure, and produces a second plurality of vias through a second side of the composite laminated structure. The method then fills the first plurality of vias and the second plurality of vias with a conductive material, where the conductive material in the first and second plurality of vias are in signal communication with the third metal that is patterned on the top surface of the fourth dielectric layer and the first metal that is pattern plated on the bottom surface of first dielectric layer. In this example, the first metal, second metal, and third metal are the same metal.

Further disclosed is a method for fabricating the BCA utilizing a three-dimensional ("3-D") additive printing process. The method includes printing a first conductive layer with conductive ink having a top surface and a first width and printing a first dielectric layer on the top surface of the first conductive layer. In these steps, the first width has a first center, the first dielectric layer has a top surface and a second width, the second width is less than the first width, and there is a first gap at a first end of the first dielectric layer and a second gap at a second end of the first dielectric layer. The method then prints a second conductive layer with conductive ink in the first and second gap of the first dielectric layer and prints a second dielectric layer on the top surface of the first dielectric layer, where the second dielectric layer has a top surface and a third width and where there is a first gap at a first end of the second dielectric layer and a second gap at a second end of the second dielectric layer. The method then prints a third conductive layer with conductive ink in the first and second gap of the second dielectric layer and prints a fourth conductive layer with conductive ink on the top surface of the second dielectric layer, where the fourth conductive layer has a top surface and a fourth width, where the fourth width is less than the third width, and where there is a first gap at a first end of the fourth conductive layer and a second gap at a second end of the fourth conductive layer. The method then prints a third dielectric layer on the top surface of the fourth conductive layer and on the top surface on the second dielectric layer, where the third dielectric layer has a top surface and a fifth width, and where there is a first gap at a first end of the third dielectric layer and a second gap at a second end of the third dielectric layer and prints a fifth conductive layer with conductive ink in the first and second gap of the third dielectric layer. Then method then prints a fourth dielectric layer on the top surface of the third dielectric layer, where the fourth dielectric layer has a top surface and a sixth width and where there is a first gap at a first end of the fourth dielectric layer and a second gap at a second end of the fourth dielectric layer. The method then prints a sixth conductive layer with conductive ink in the first and second gap of the fourth dielectric layer and prints a seventh conductive layer with conductive ink on the top surface of the fourth dielectric layer, where the seventh conductive layer includes an antenna slot along the seventh conductive pattern that exposes the top surface of the fourth dielectric pattern through the seventh conductive pattern.

Other devices, apparatus, systems, methods, features, and advantages of the invention will be or will become apparent to one with skill in the art upon examination of the following figures and detailed description. It is intended that all such additional systems, methods, features, and advantages be included within this description, be within the scope of the invention, and be protected by the accompanying claims.

BRIEF DESCRIPTION OF THE FIGURES

The invention may be better understood by referring to the following figures. The components in the figures are not necessarily to scale, emphasis instead being placed upon illustrating the principles of the invention. In the figures, like reference numerals designate corresponding parts throughout the different views.

DETAILED DESCRIPTION

Figure 1:
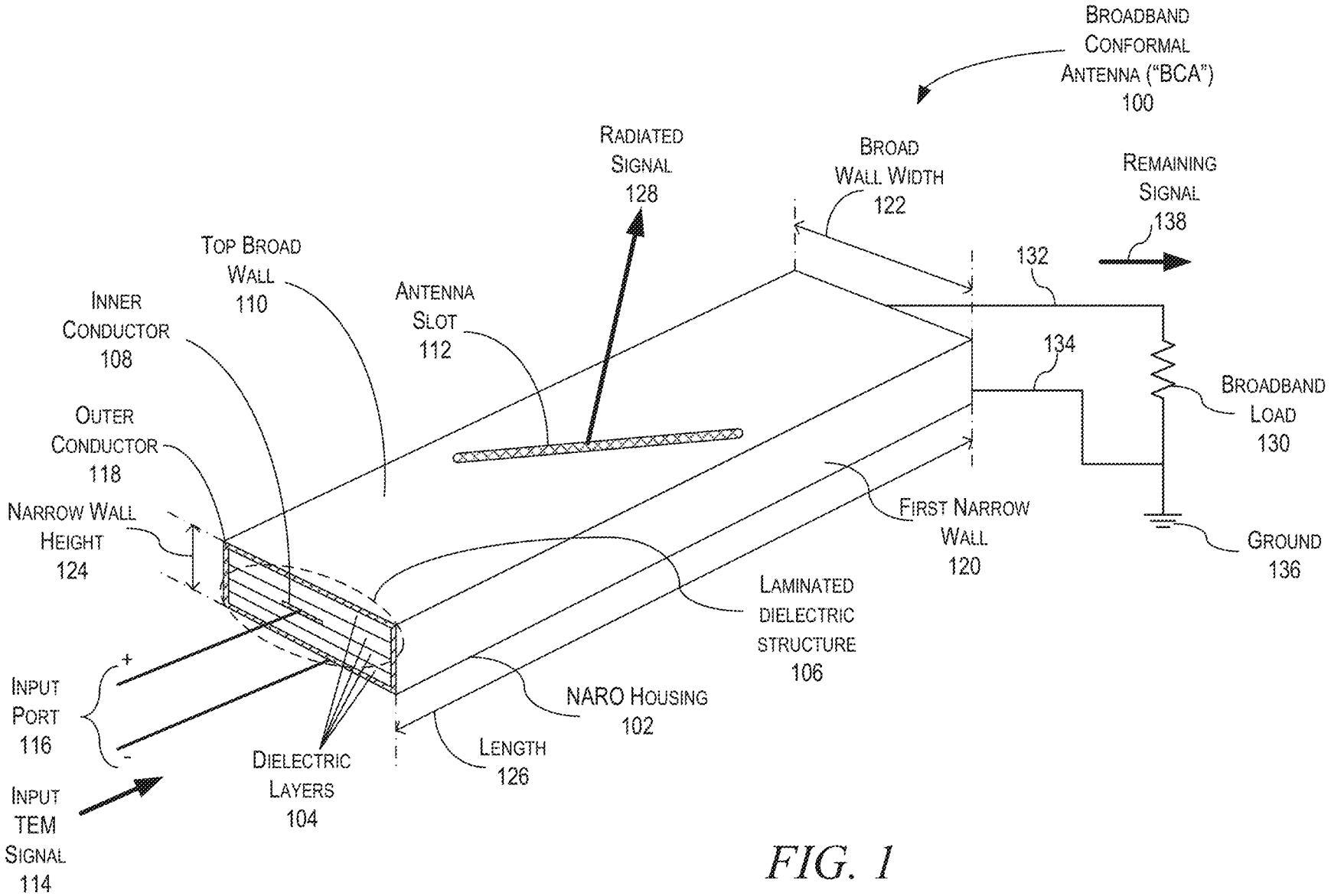
FIG. 1 is a perspective view of an example of an implementation of a broadband conformal antenna ("BCA") in accordance with the present disclosure.

A broadband conformal antenna ("BCA") is disclosed. The BCA includes a narrow approximately rectangular outer conductive ("NARO") housing, a plurality of dielectric layers within the NARO housing forming a laminated dielectric structure, and an inner conductor formed within the laminated dielectric structure. The NARO housing includes a top broad wall and the BCA further includes an antenna slot within the top broad wall. The BCA is configured to support a transverse electromagnetic signal within the NARO housing.

Also disclosed is a method for fabricating the BCA utilizing a lamination process. The method includes patterning a first metal on a first dielectric layer having a top surface and a bottom surface and patterning a second metal on a second dielectric layer having a top surface and a bottom surface. The first metal is patterned on the bottom surface of first dielectric layer and the second metal is patterned on a portion of the top surface of the second dielectric layer, where the second metal is patterned on the second dielectric layer to produce an inner conductor. The method then laminates the bottom surface of the second dielectric layer on the top surface of the first dielectric layer and laminates a third dielectric layer, having a top surface and a bottom surface, on the top surface of the second dielectric layer, where the bottom surface of the third dielectric layer is laminated on to the top surface of the second dielectric layer. The method then patters a third metal on a fourth dielectric layer having a top surface and a bottom surface, where the third metal is patterned on the top surface of the fourth dielectric layer to produce a top broad wall and where the metal of the top broad wall is patterned to include an antenna slot along the top broad wall that exposes the top surface of the fourth dielectric layer through the metal of the top broad wall. The method then laminates the bottom surface of fourth dielectric layer on to the top surface of the third dielectric layer to produce a composite laminated structure, produces a first plurality of vias through a first side of the composite laminated structure, and produces a second plurality of vias through a second side of the composite laminated structure. The method then fills the first plurality of vias and the second plurality of vias with a conductive material, where the conductive material in the first and second plurality of vias are in signal communication with the third metal that is patterned on the top surface of the fourth dielectric layer and the first metal that is pattern plated on the bottom surface of first dielectric layer. In this example, the first metal, second metal, and third metal are the same metal.

Further disclosed is a method for fabricating the BCA utilizing a three-dimensional ("3-D") additive printing process. The method includes printing a first conductive layer with conductive ink having a top surface and a first width and printing a first dielectric layer on the top surface of the first conductive layer. In these steps, the first width has a first center, the first dielectric layer has a top surface and a second width, the second width is less than the first width, and there is a first gap at a first end of the first dielectric layer and a second gap at a second end of the first dielectric layer. The method then prints a second conductive layer with conductive ink in the first and second gap of the first dielectric layer and prints a second dielectric layer on the top surface of the first dielectric layer, where the second dielectric layer has a top surface and a third width and where there is a first gap at a first end of the second dielectric layer and a second gap at a second end of the second dielectric layer. The method then prints a third conductive layer with conductive ink in the first and second gap of the second dielectric layer and prints a fourth conductive layer with conductive ink on the top surface of the second dielectric layer, where the fourth conductive layer has a top surface and a fourth width, where the fourth width is less than the third width, and where there is a first gap at a first end of the fourth conductive layer and a second gap at a second end of the fourth conductive layer. The method then prints a third dielectric layer on the top surface of the fourth conductive layer and on the top surface on the second dielectric layer, where the third dielectric layer has a top surface and a fifth width, and where there is a first gap at a first end of the third dielectric layer and a second gap at a second end of the third dielectric layer and prints a fifth conductive layer with conductive ink in the first and second gap of the third dielectric layer. Then method then prints a fourth dielectric layer on the top surface of the third dielectric layer, where the fourth dielectric layer has a top surface and a sixth width and where there is a first gap at a first end of the fourth dielectric layer and a second gap at a second end of the fourth dielectric layer. The method then prints a sixth conductive layer with conductive ink in the first and second gap of the fourth dielectric layer and prints a seventh conductive layer with conductive ink on the top surface of the fourth dielectric layer, where the seventh conductive layer includes an antenna slot along the seventh conductive pattern that exposes the top surface of the fourth dielectric pattern through the seventh conductive pattern.

More specifically, in FIG. 1, a perspective view of an example of an implementation of the BCA 100 is shown in accordance with the present disclosure. The BCA 100 includes the NARO housing 102, a plurality of dielectric layers 104 within the NARO housing 102 forming a laminated dielectric structure 106, and an inner conductor 108 formed within the laminated dielectric structure 106. In this example, the NARO housing 102 includes a top broad wall 110 and the BCA 100 further includes an antenna slot 112 within the top broad wall 110. The BCA 100 is configured to radiate a transverse electromagnetic ("TEM") input signal 114 that is injected into an input port 116 of the BCA 100. In this example, the NARO housing 102 is a metallic shield acting as an outer conductor 118 that surrounds the laminated dielectric structure 106. In this example, the input port 116 is shown with both the inner conductor 108 and outer conductor 118 where the inner conductor 108 has a first polarity, for example, positive, with regards to a second and opposite polarity (for example, negative) of the outer conductor 118. However, it is appreciated by those of ordinary skill in the art that the polarities may be reversed.

It is appreciated by those of ordinary skill in the art that the circuits, components, modules, and/or devices of, or associated with, the BCA 100 are described as being in signal communication with each other, where signal communication refers to any type of communication and/or connection between the circuits, components, modules, and/or devices that allows a circuit, component, module, and/or device to pass and/or receive signals and/or information from another circuit, component, module, and/or device. The communication and/or connection may be along any signal path between the circuits, components, modules, and/or devices that allows signals and/or information to pass from one circuit, component, module, and/or device to another and includes wireless or wired signal paths. The signal paths may be physical, such as, for example, conductive wires, electromagnetic wave guides, cables, attached and/or electromagnetic or mechanically coupled terminals, semi-conductive or dielectric materials or devices, or other similar physical connections or couplings. Additionally, signal paths may be non-physical such as free-space (in the case of electromagnetic propagation) or information paths through digital components where communication information is passed from one circuit, component, module, and/or device to another in varying digital formats without passing through a direct electromagnetic connection.

In general, the NARO housing 102 may be constructed of any conductive material. The conductive material may be copper, aluminum, silver, or any other conductive material. Similarly, the inner conductor 108 may also be constructed of any conductive material. In this example, the NARO housing 102 may include the top broad wall 110, a bottom broad wall (not shown) but located opposite of the top broad wall 110, a first narrow wall 120, and a second narrow wall (not shown). The top broad wall 110 and bottom broad wall (not shown) will have a broad wall width 122 and the first narrow wall 120 and second narrow wall (not shown) will have narrow wall height 124. The BCA 100 also includes a BCA length 126 that is equal to the length of the top broad wall 110 and the length of the first narrow wall 120. In this example, each dielectric layer, of the plurality of dielectric layers 104, may be a dielectric laminate material and the inner conductor 108 may be a stripline conductor. The inner conductor 108 may be located at a first position within the NARO housing 102 that is approximately at a center position that is equal to half of the narrow wall height 124 and wherein the inner conductor 108 has an inner conductor center that is located at second position within the NARO housing 102 that is approximately at a second center position that is equal to half of the broad wall width 122. As an example, the dielectric laminate material may be constructed of PYRALUX® flexible circuit materials produced by E. I. du Pont de Nemours and Company of Wilmington, Del.

Alternatively, utilizing a three-dimensional ("3-D") printer, each dielectric layer be constructed by printing a dielectric layer with the 3-D printer and the inner conductor 108 may be constructed by printing a conductive layer with conductive ink on top of a printed dielectric layer with the 3-D printer.

In both of these examples, each dielectric layer may have a thickness that is approximately equal to 10 mils and top broad wall 110 and bottom broad wall (not shown) may have an outer conductor 118 thickness that is approximately equal to 0.7 mils. The first narrow wall 120 and second narrow wall (not shown) may also have an outer conductor 118 thickness that is approximately equal to 0.7 mils. As an example, the broad wall width 122 may be approximately twice the narrow wall height 124. For example, if the laminated dielectric structure 106 includes four (4) dielectric layers that are each 10 mils, the total thickness of the laminated dielectric structure 106 would be 40 mils. If the outer conductor 118 is 0.7 mils at the top broad wall 110 and bottom broad wall (not shown), the total narrow wall height 124 would be 41.4 mils. In this example, the broad wall width 122 may be approximately 82.8 mils. Additionally, in this example, the BCA length 126 may be approximately equal to 1181 mils.

The antenna slot 112 is angled along the top broad wall 110 such as to radiate (i.e., emit) a "radiated signal" 128 that is first produced by the input TEM signal 114 and then propagates along the BCA length 126 of the BCA 100. It is appreciated by those of ordinary skill in the art that the electromagnetic characteristics of the radiated signal 128 are determined by the shape, width, length, position, and angle of the antenna slot 112 along the top broad wall 110. In this example, the BCA 100 may also include a broadband load 130 electrically connected to the inner conductor 108 and outer conductor 118 via a first signal path 132 and a second signal path 134. In this example, the broadband load 130 and outer conductor 118 are electrically connected to a ground plane 136. Generally, the BCA 100 has a characteristic impedance and the broadband load 130 has an impedance that is approximately equal to the characteristic impedance of the BCA 100 such as to minimize return loss. As an example, both the characteristic impedance of the BCA 100 and impedance of the broadband load 130 may be 50 ohms.

In general, the BCA 100 is a leaky-wave antenna (a type of traveling-wave antenna) that utilizes a traveling wave (i.e., the input TEM signal 114 terminated into a finite load) that is coupled to an antenna slot 112 along a guiding structure (i.e., BCA 100). In an example of operation, the input TEM signal 114 is injected into the input port 116 and propagates through the BCA 100 to the broadband load 130. As the input TEM signal 114 travels through the BCA 100, part of the energy is radiated out of the antenna slot 112 as the radiated signal 128, while the remaining energy is transmitted to the broadband load 130 as a remaining signal.

Figure 2:
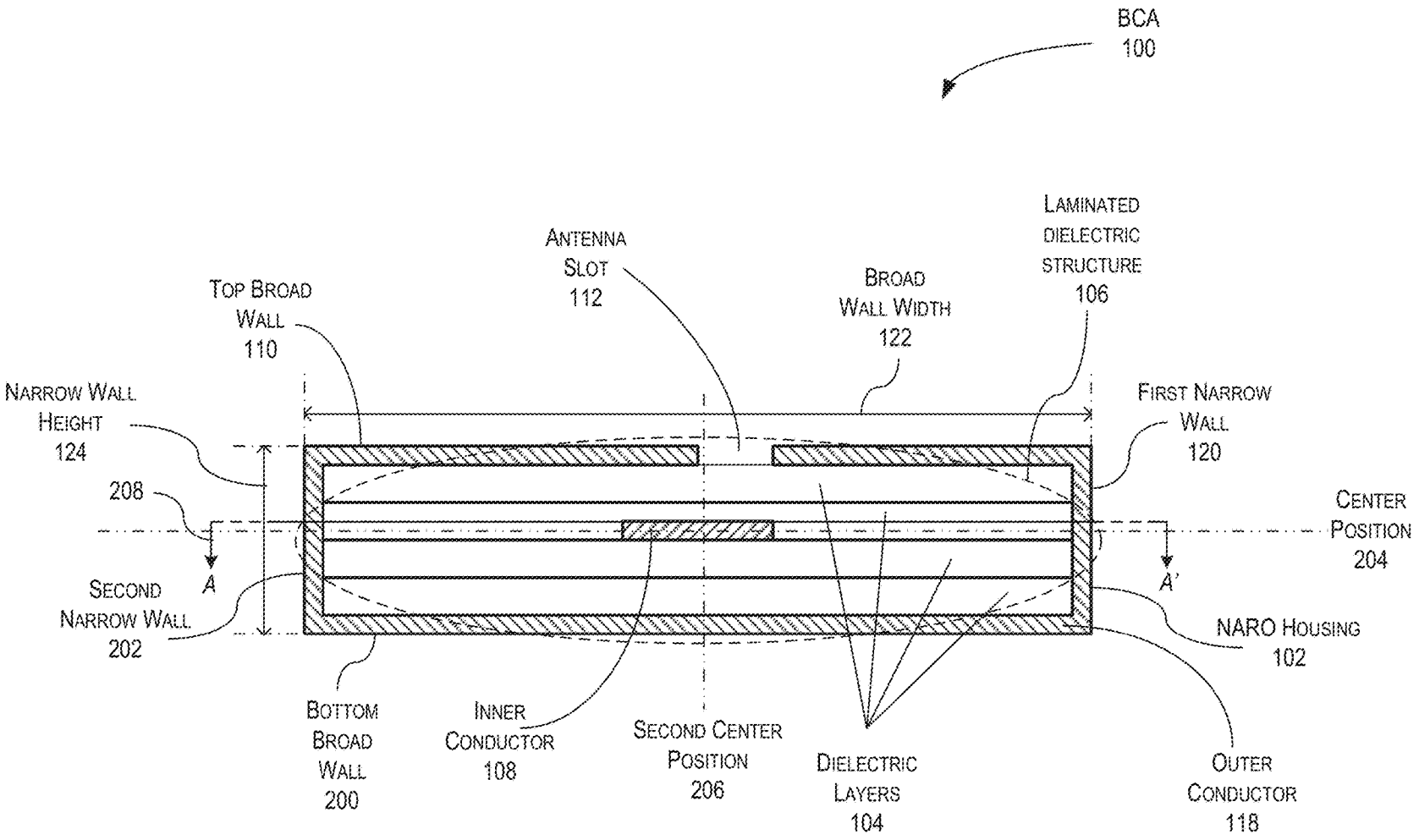
FIG. 2 is a cross-sectional view of the BCA shown in FIG. 1 in accordance with the present disclosure.

In FIG. 2, a cross-sectional view of the BCA 100 is shown in accordance with the present disclosure. In this view, the NARO housing 102, plurality of dielectric layers 104, laminated dielectric structure 106, inner conductor 108, top broad wall 110, bottom broad wall 200, antenna slot 112, outer conductor 118, first narrow wall 120, and the second narrow wall 202 are shown. The center position 204 that is equal to half of the narrow wall height 124 and the second center position 206 that is equal to half of the broad wall width 122 are also shown. It is appreciated by those of ordinary skill in the art that while only four (4) dielectric layers are shown in the plurality of dielectric layers 104, any number greater than two (2) may be utilized for the number of dielectric layers of the plurality of dielectric layers 104. In this example, cutting plane A-A' 208 is shown looking into the BCA 100.

Figure 3:
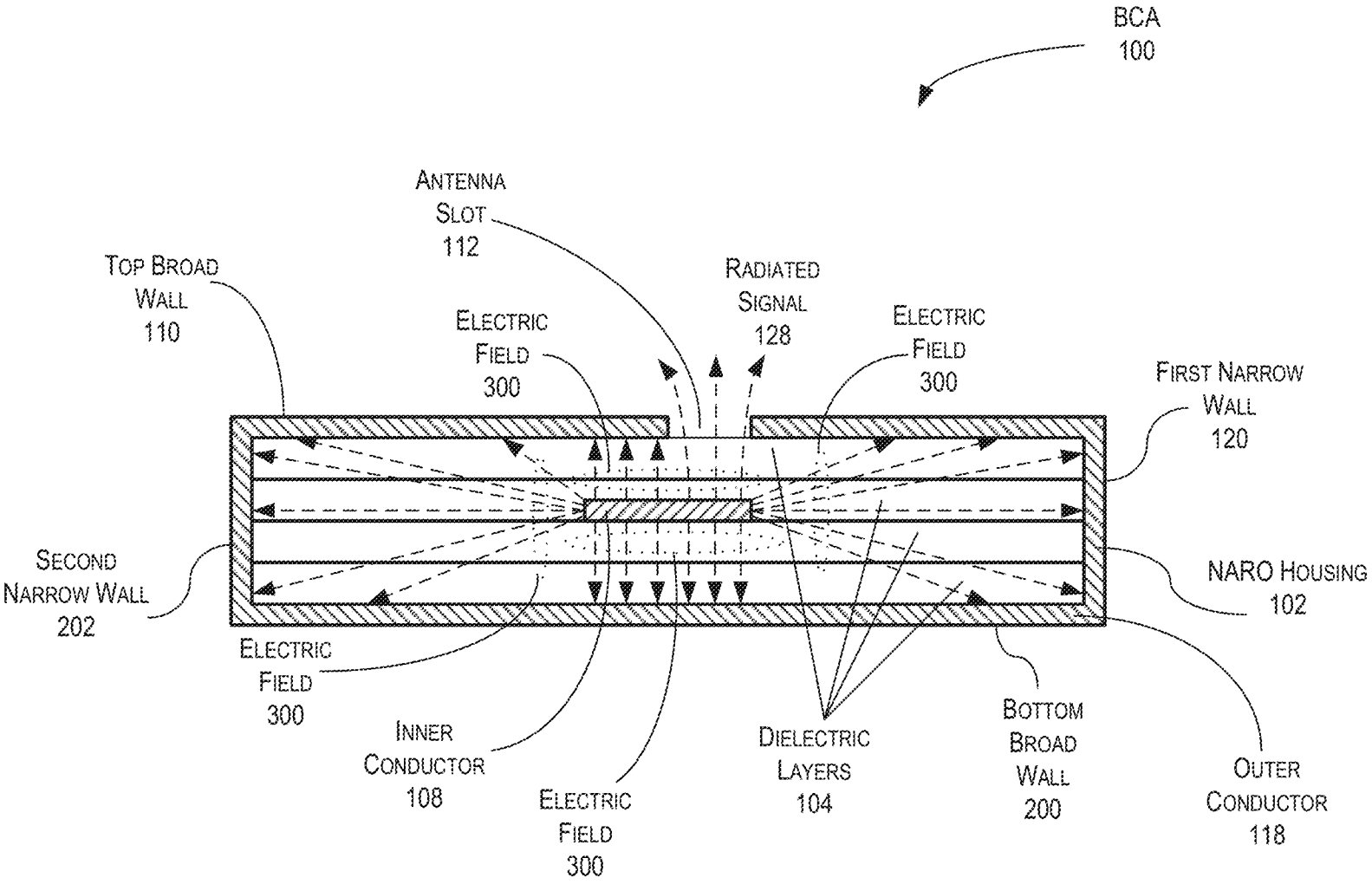
FIG. 3 is a cross-sectional view of the BCA shown in FIGS. 1 and 2 illustrating the electric field produced by a transverse electromagnetic wave (TEM) that propagates through the BCA in accordance with the present disclosure.

In an example of operation, in FIG. 3, another cross-sectional view of the BCA 100 (shown in FIGS. 1 and 2) is shown illustrating the electric field 300 produced by the input TEM signal 114 that propagates through the BCA 100 in accordance with the present disclosure. In this example, the electric field 300 is shown traveling from the inner conductor 108 to the outer conductor 118.

Figure 4:
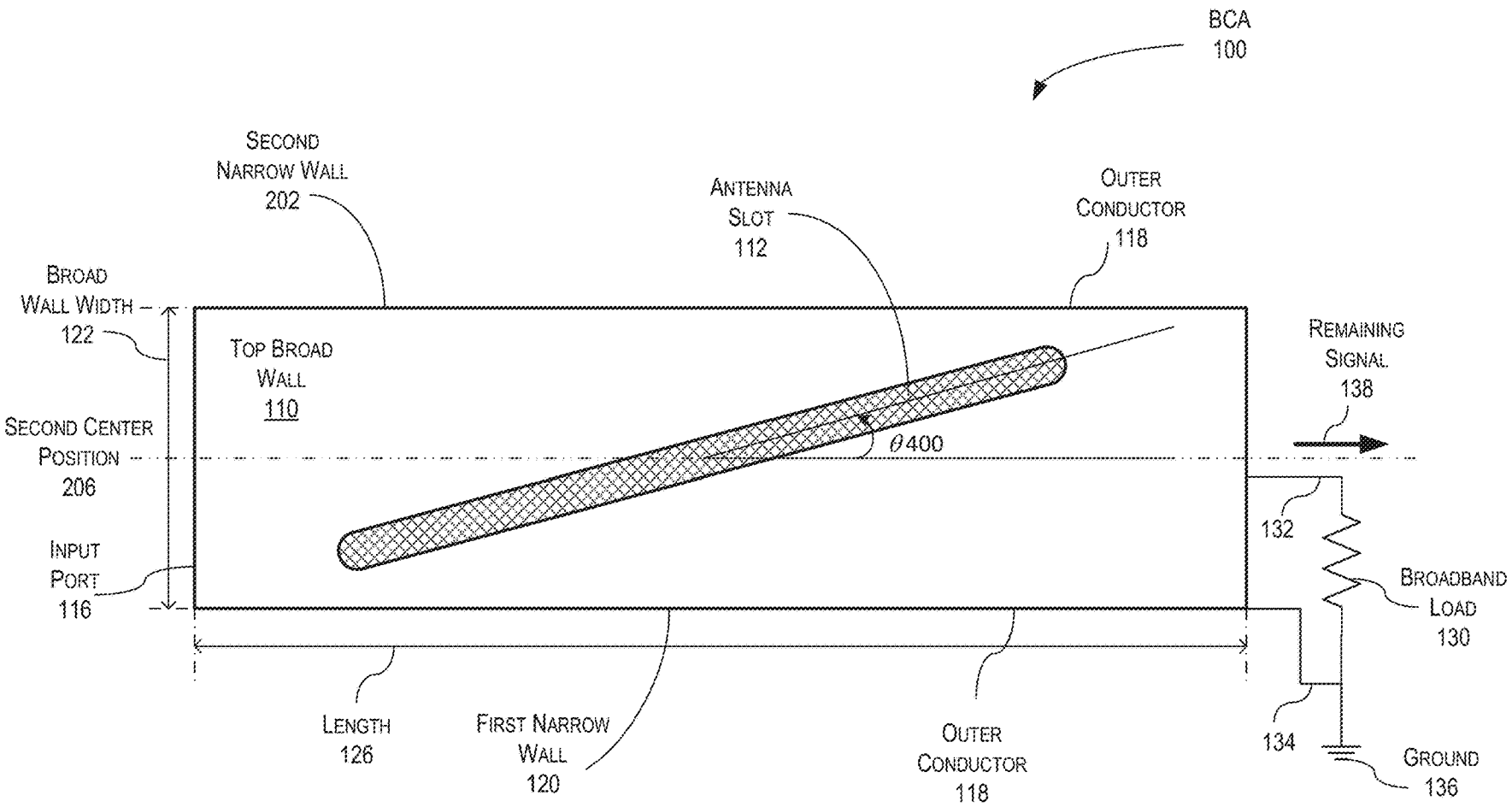
FIG. 4 is a top view of the BCA shown in FIGS. 1-3 in accordance with the present disclosure.

FIG. 4 is a top view of the BCA 100 shown in FIGS. 1-3 in accordance with the present disclosure. In this example, the antenna slot 112 in the top broad wall 110 is shown to be angled at an angle □400 with respect to the second center position 206. In this example, the antenna slot 112 is shown to be centered about the second center position 206. The angle □400 may be negative or positive.

Figure 5:
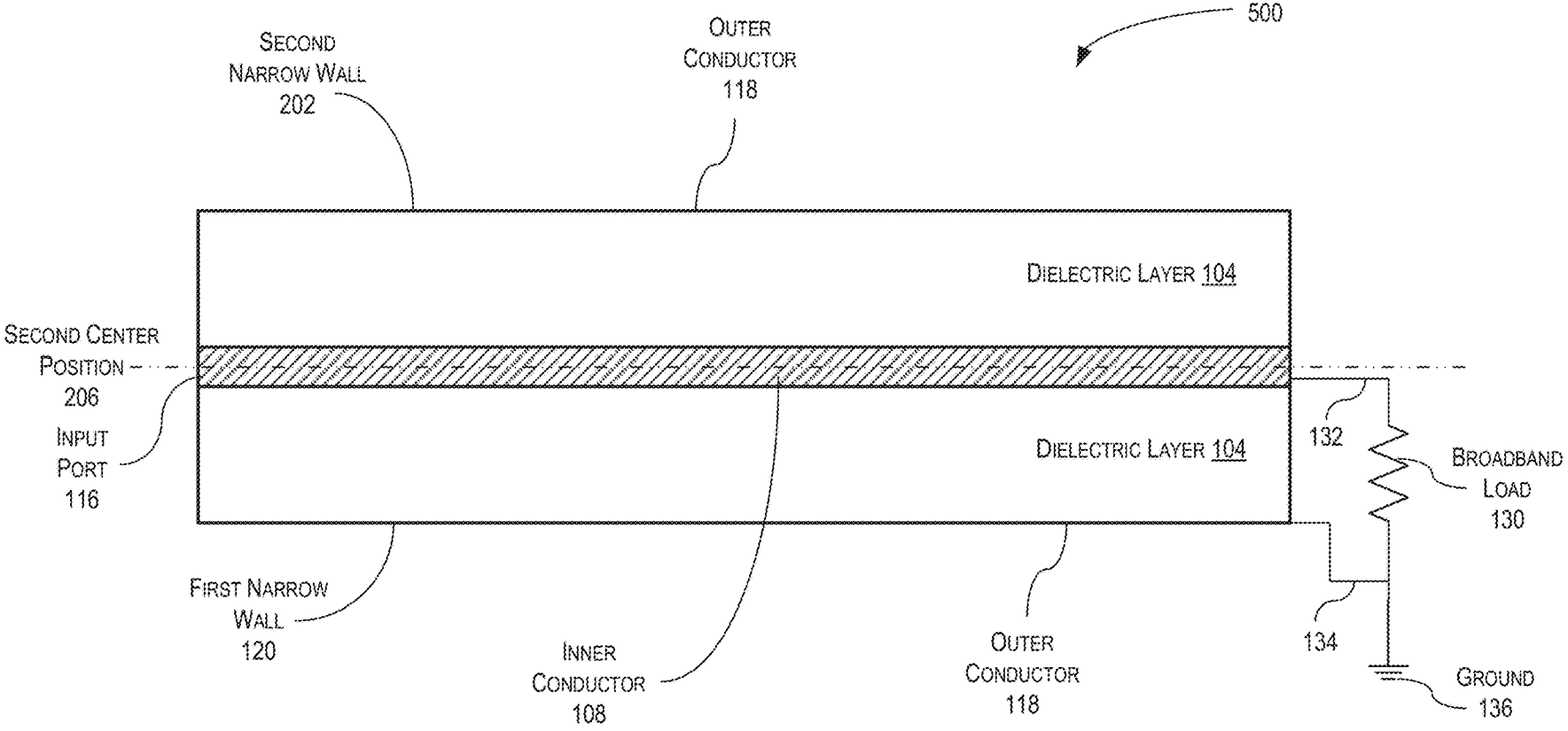
FIG. 5 is a cross-sectional view perpendicular to FIGS. 2-3 showing the inner conductor running along a BCA length in accordance with the present disclosure.

FIG. 5 is a cross-sectional view perpendicular to FIGS. 2-3 showing the inner conductor 108 running along the BCA 100 length 126 in accordance with the present disclosure. In this example, the inner conductor 108 is shown to be in a middle layer of the laminated dielectric structure 106 between two dielectric layers 104.

Figure 6:
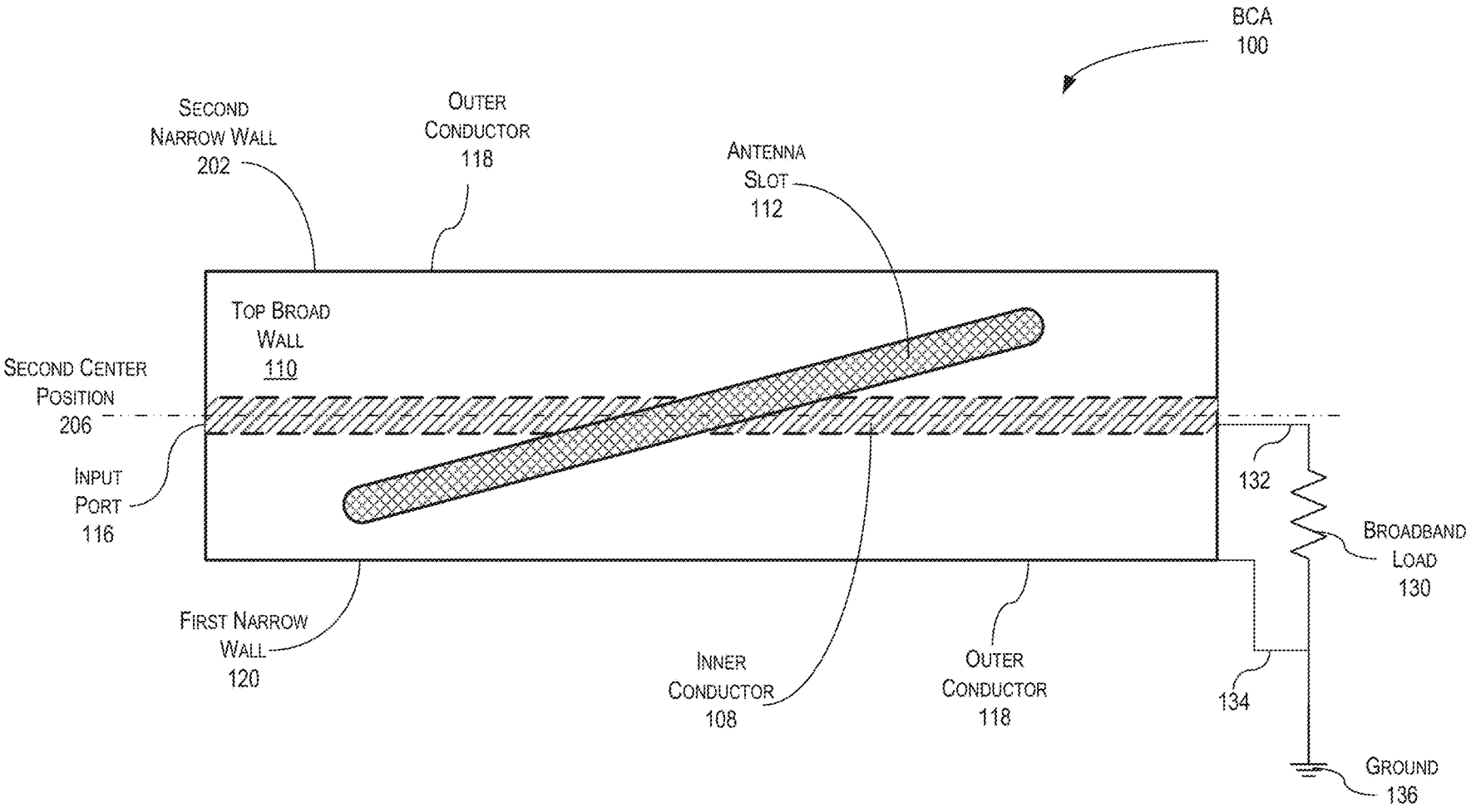
FIG. 6 is a top exposed view of the BCA 100 shown in FIGS. 1-4 in accordance with the present disclosure.

FIG. 6 is another top view of the BCA 100 shown in FIGS. 1-4 in accordance with the present disclosure. This view is similar to the top view shown in FIG. 4 with the addition of showing the hidden inner conductor 108 within the BCA 100.

Figure 7:
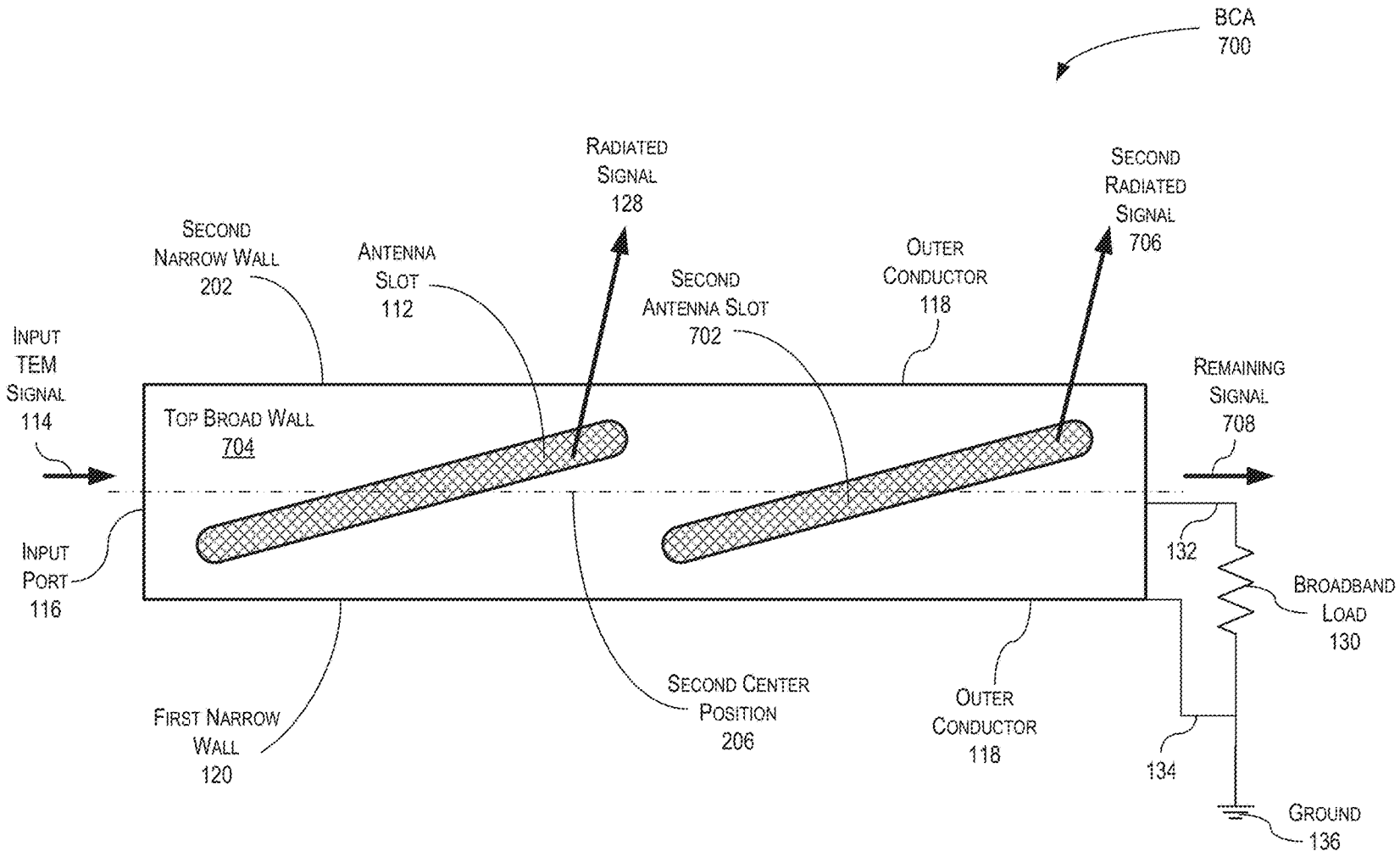
FIG. 7 is a top view of an example of another implementation of the BCA in accordance with the present disclosure.

In FIG. 7, a top view of an example of an implementation of the BCA 700 is shown in accordance with the present disclosure. In this example, the BCA 700 is a 2×1 array that includes a second antenna slot 702 within the top broad wall 704. As discussed before, the inner conductor 108 and outer conductor 118 of the BCA 700 are electrically connected to the broadband load 130 via signal paths 132 and 134, where the first signal path 132 is electrically connected to the inner conductor 108 and the second signal path 134 is electrically connected to the outer conductor 118.

In an example of operation, the input TEM signal 114 is injected into input port 116 and propagates through the BCA 700 towards the broadband load 130. While propagating through the BCA 700, a first part of the energy of the input TEM signal 114 is radiated out of the antenna slot 112 as radiated signal 128. The remaining energy continues to propagate through the remaining portion of the BCA 700. While propagating through the remaining portion of the BCA 700, a second part of the remaining energy is radiated out of the second antenna slot 702 as a second radiated signal 706. The remaining signal 708 is then transmitted to the broadband load 130.

Figure 8:
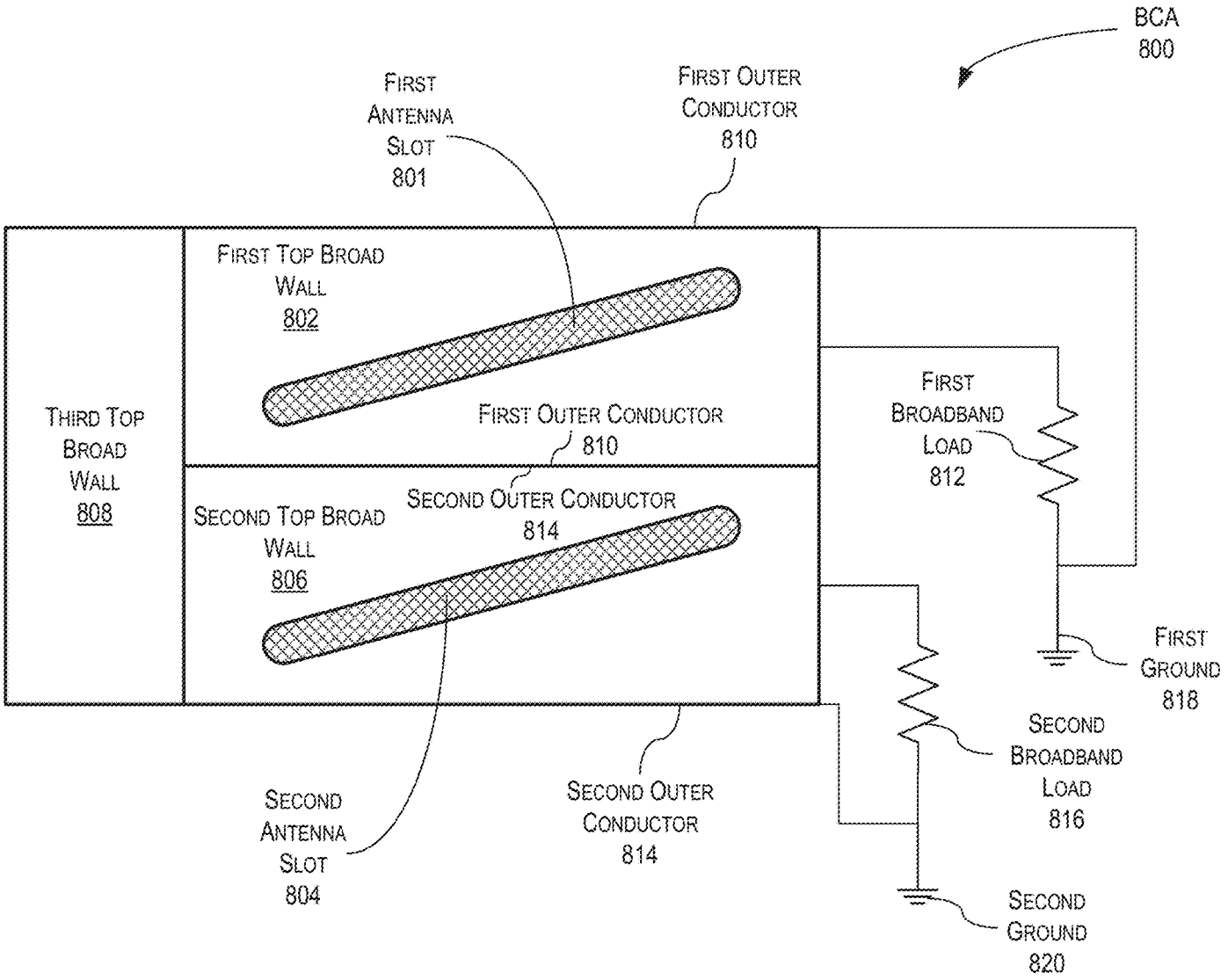
FIG. 8 is a top view of an example of yet another implementation of the BCA in accordance with the present disclosure.

In FIG. 8, a top view of an example of yet another implementation of the BCA 800 is shown in accordance with the present disclosure. In this example, the BCA 800 is a 1×2 array that includes a first antenna slot 801 within a first top broad wall 802 and second antenna slot 804 within a second top broad wall 806. In this example, the first top broad wall 802 is covering a first inner conductor (not shown) and the second top broad wall 806 is covering a second inner conductor (not shown). The first and second inner conductors are electrically connected to a power divider (not shown) that is covered by a third top broad wall 808.

In this example, the first inner conductor and first outer conductor 810 are electrically connected to a first broadband load 812 and the second inner conductor and second outer conductor 814 are electrically connected to a second broadband load 816. The first broadband load 812 is electrically connected to a first ground plane 818 and the second broadband load 816 is electrically connected to a second ground plane 820.

Figure 9:
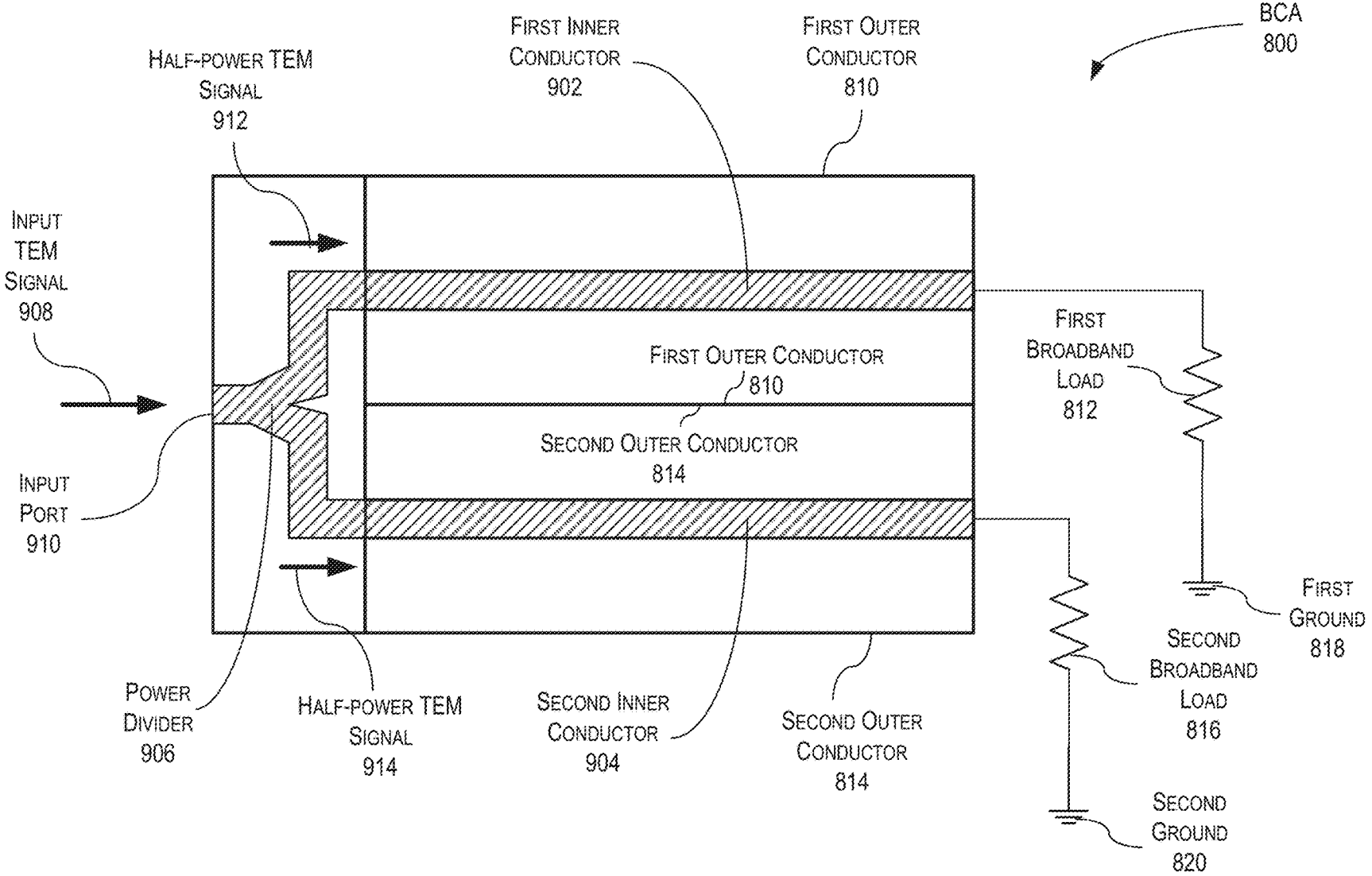
FIG. 9 is a top exposed view of a cut-away portion of the BCA (shown in FIG. 8) in accordance with the present disclosure.

In FIG. 9, a top exposed view of a cut-away portion of the BCA 800 (shown in FIG. 8) showing the first inner conductor 902, the second inner conductor 904, and power divider 906. In this example, the power divider 906 may be a stripline type that divides the input TEM signal 908 at the input port 910 into two equal half-power input TEM signals 912 and 914 that are injected into the first inner conductor 902 and second inner conductor 904.

Figure 10:
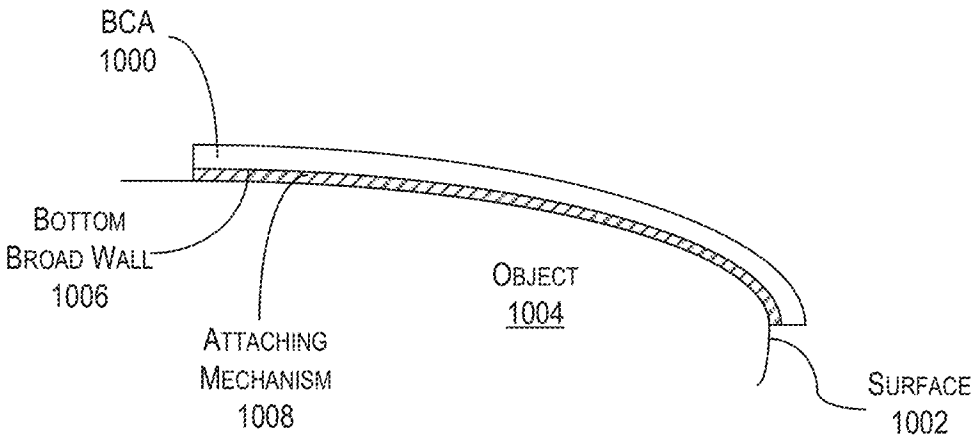
FIG. 10 is a side view of an example of an implementation of the BCA attached to a surface of an object in accordance with present disclosure.

In FIG. 10, a side view of an example of an implementation of the BCA 1000 is shown attached to a surface 1002 of an object 1004 in accordance with present disclosure. In this example, the BCA 1000 includes a bottom broad wall 1006 that includes an attaching mechanism 1008. The attaching mechanism 1008 attaches the BCA 1000 to the surface 1002 of the object 1004. The attaching mechanism 1008 may include various types of attaching means including, for example, magnets, adhesive, a first linear fabric strip having a plurality of small hooks and a second linear fabric strip having a plurality of small loops configured to couple with the first linear fabric strip (i.e., a material such as VELCRO® produced by Velcro Companies of the United Kingdom), nails, screws, fasteners, rivets, or other types of attaching means. In this example, BCA 1000 is flexible and may conformably attach to the surface 1002 of the object 1004 that may be optionally flat or curved.

Figure 11:
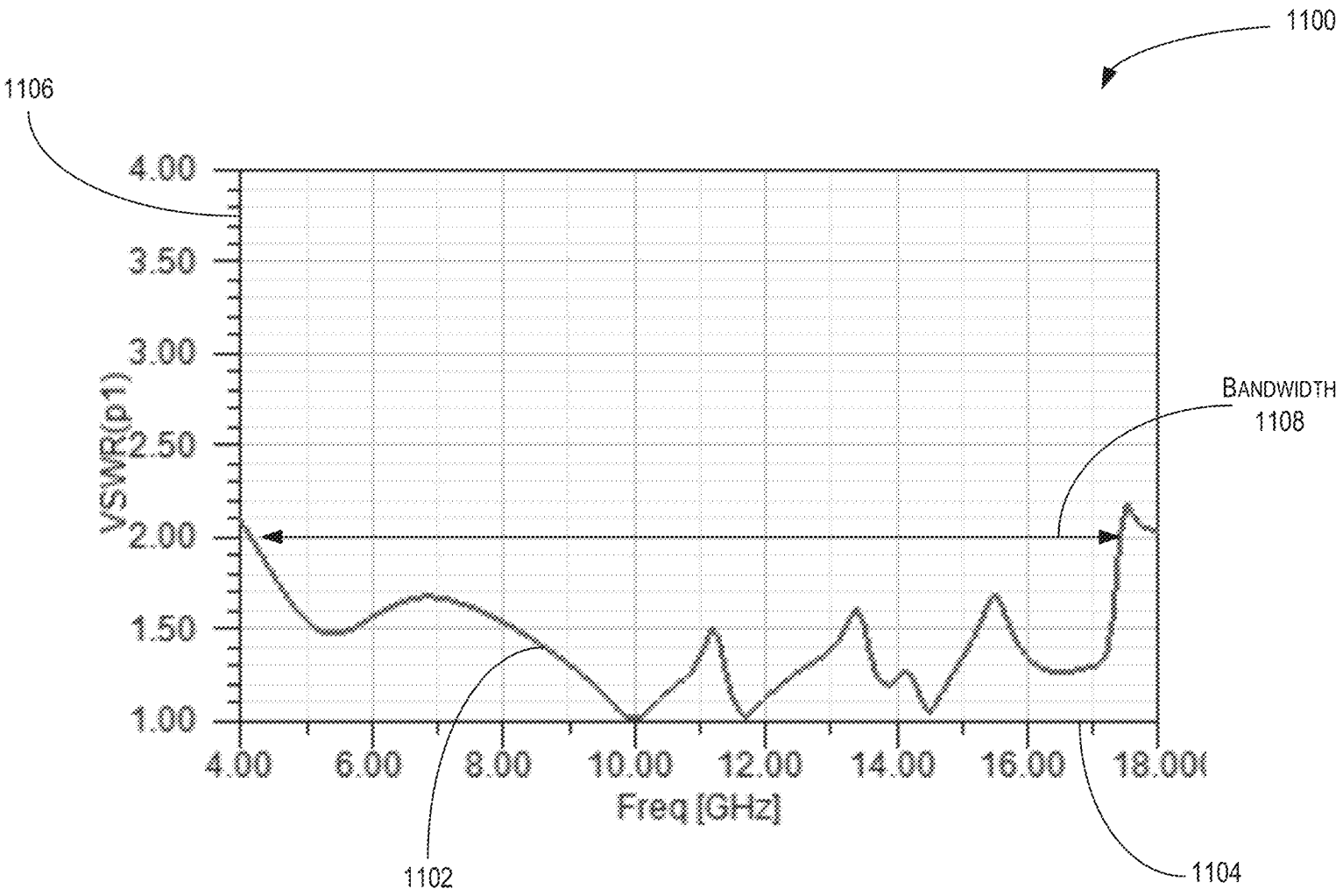
FIG. 11 is a plot of an example of the performance of the BCA (shown in FIG. 7) in terms of voltage standing wave ratio (VSWR) versus frequency in accordance with the present disclosure.

In FIG. 11, a graph 1100 of a plot 1102 is shown of an example of the performance of the BCA 700 of FIG. 7 in terms of voltage standing wave ratio ("VSWR") versus frequency in accordance with the present disclosure. In this example, the horizontal axis 1104 represents the frequency in GHz and the vertical axis 1106 represent the VSWR. The horizontal axis 1104 varies from 4 to 18 GHz and the vertical axis 1106 varies from 1 to 4. In this example, the antenna slot 112 and second antenna slot 702 are assumed to be designed to resonant around 10 GHz. The resulting plot 1102 of the VSWR shows the antenna has a 2:1 VSWR bandwidth 1108 greater than 13 GHz. In this example, the antenna gain is approximate 3.72 dBi at 10 GHz.

Turning to FIGS. 12A-12G, a stack up method for fabricating the BCA (i.e., either BCA 100, 700, 800, or 1000) utilizing a lamination process is shown. Specifically, in FIG. 12A, a cross-sectional view of a first section 1200 of the BCA is shown in accordance with the present disclosure. The first section 1200 of the BCA includes a first dielectric layer 1202 and a first metal layer 1204 patterned on the first dielectric layer 1202 to form a broad wall. The first dielectric layer 1202 has a top surface 1206 and a bottom surface 1208 and the first metal layer 1204 is patterned on the bottom surface 1208 of the first dielectric layer 1202. In this example, the first metal layer 1204 is part of the outer conductor of the BCA.

Figure 12A:
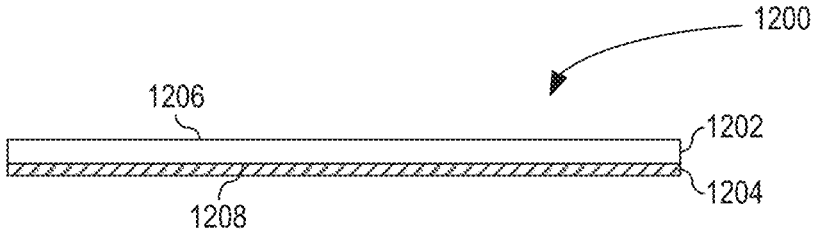
FIG. 12A is a cross-sectional view of a first section of the BCA in accordance with the present disclosure.
Figure 12B:
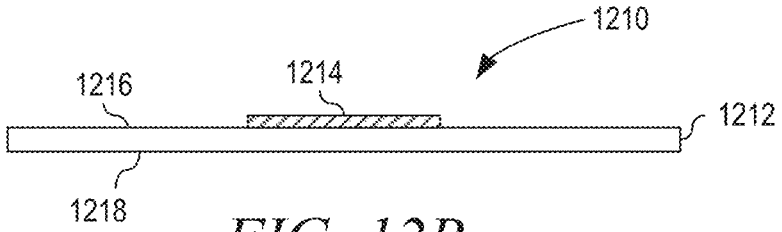
FIG. 12B is a cross-sectional view of a second section of the BCA in accordance with the present disclosure.

In FIG. 12B, a cross-sectional view of a second section 1210 of the BCA is shown in accordance with the present disclosure. The second section 1210 of the BCA includes a second dielectric layer 1212 and a second metal layer 1214 patterned on the second dielectric layer 1212. The second dielectric layer 1212 has a top surface 1216 and a bottom surface 1218 and the second metal layer 1214 is patterned on a portion of the top surface 1216 of the second dielectric layer 1212. In this example, the second metal layer 1214 is an inner conductor of the BCA.

Figure 12C:
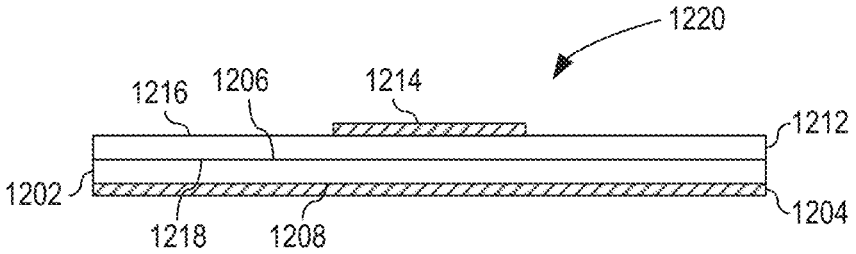
FIG. 12C is a cross-sectional view of a first combination of the first section and the second section of the BCA in accordance with the present disclosure.

In FIG. 12C, a cross-sectional view of a first combination 1220 of the first section 1200 and the second section 1210 of the BCA is shown in accordance with the present disclosure. The first combination 1220 is formed by laminating the bottom surface 1218 of the second dielectric layer 1212 on the top surface 1206 of the first dielectric layer 1202.

Figure 12D:
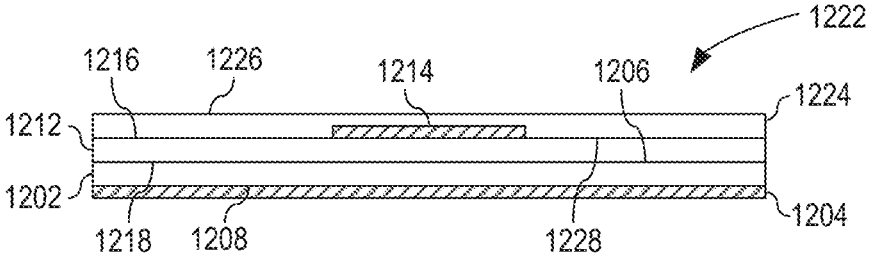
FIG. 12D is a cross-sectional view of a second combination that includes the first combination and a third dielectric layer of the BCA in accordance with the present disclosure.

In FIG. 12D, a cross-sectional view of a second combination 1222 that includes the first combination 1220 and a third dielectric layer 1224 of the BCA is shown in accordance with the present disclosure. The third dielectric layer 1224 includes a top surface 1226 and a bottom surface 1228, where the bottom surface 1228 of the third dielectric layer 1224 is laminated on the second metal layer 1214 and the top surface 1216 of the second dielectric layer 1212.

Figure 12E:
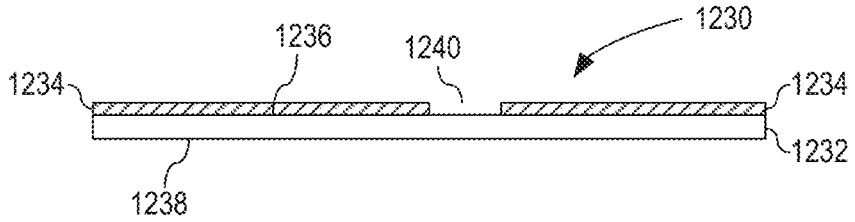
FIG. 12E is a cross-sectional view of a third section of the BCA in accordance with the present disclosure.

In FIG. 12E, a cross-sectional view of a third section 1230 of the BCA is shown in accordance with the present disclosure. The third section 1230 of the BCA includes a fourth dielectric layer 1232 and a third metal layer 1234 patterned on the fourth dielectric layer 1232. The fourth dielectric layer 1232 has a top surface 1236 and a bottom surface 1238 and the third metal layer 1234 is patterned on the top surface 1236 of the fourth dielectric layer 1232. The third metal layer 1234 includes an antenna slot 1240.

Figure 12F:
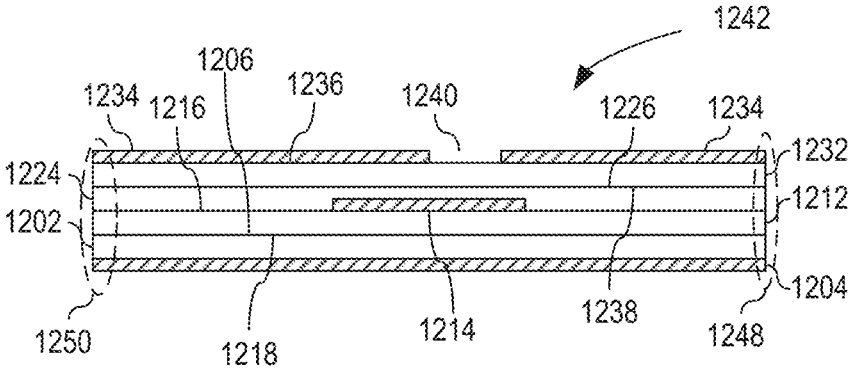
FIG. 12F is a cross-sectional view of a composite laminated structure of the second combination and a third section of the BCA in accordance with the present disclosure.

In FIG. 12F, a cross-sectional view of a composite laminated structure 1242 of the second combination 1222 and a third section 1230 of the BCA is shown in accordance with the present disclosure. The composite laminated structure 1242 is formed by laminating the bottom surface 1238 of the fourth dielectric layer 1232 on the top surface 1226 of the third dielectric layer 1224.

Figure 12G:
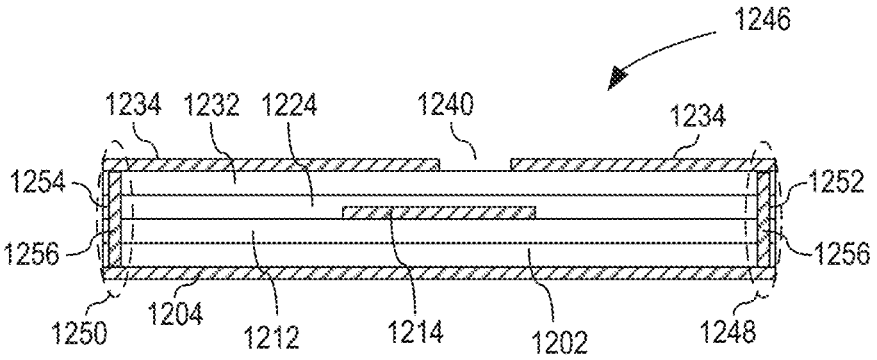
FIG. 12G is a cross-sectional view of a BCA formed by the lamination process in accordance with the present disclosure.

In FIG. 12G, a cross-sectional view of a BCA 1246 formed by the lamination process is shown in accordance with the present disclosure. In this example, the BCA 1246 includes the composite laminated structure 1242 where the composite laminated structure 1242 includes a first side 1248 and a second side 1250. The BCA 1246 includes a first plurality of vias 1252 at the first side 1248 and a second plurality of vias 1254 at the second side 1250 that have been perforated through the entire height of the composite laminated structure 1242 from the first metal layer 1204 to the third metal layer 1234. The first and second plurality of vias 1252 and 1254 have been populated with a conductive material 1256 to electrically connect and short the first metal layer 1204 to the third metal layer 1234 at the first and second sides 1248 and 1250 of the composite laminated structure 1242. As discussed earlier, the first metal layer 1204 and third metal layer 1234 form part of the outer conductor 118, where the first metal layer 1204 corresponds to the bottom broad wall 200 and the third metal layer 1234 corresponds to the top broad wall 110. Similarly, the conductive material 1256 within the first plurality of vias 1252 and the second plurality of vias 1254 also correspond to the outer conductor, where the first plurality of vias 1252 corresponds to the first narrow wall 120 and the second plurality of vias 1254 corresponds to the second narrow wall 202. In this example, the conductive material 1256 may be a conductive epoxy or other conductive material. Similarly, the first, second, and third metal layers (1204, 1214, and 1234, respectively) are a conductive material that may be a metal (e.g., copper, gold, silver, aluminum, steel, or other conductive metal) or other conductive material.

Figure 13:
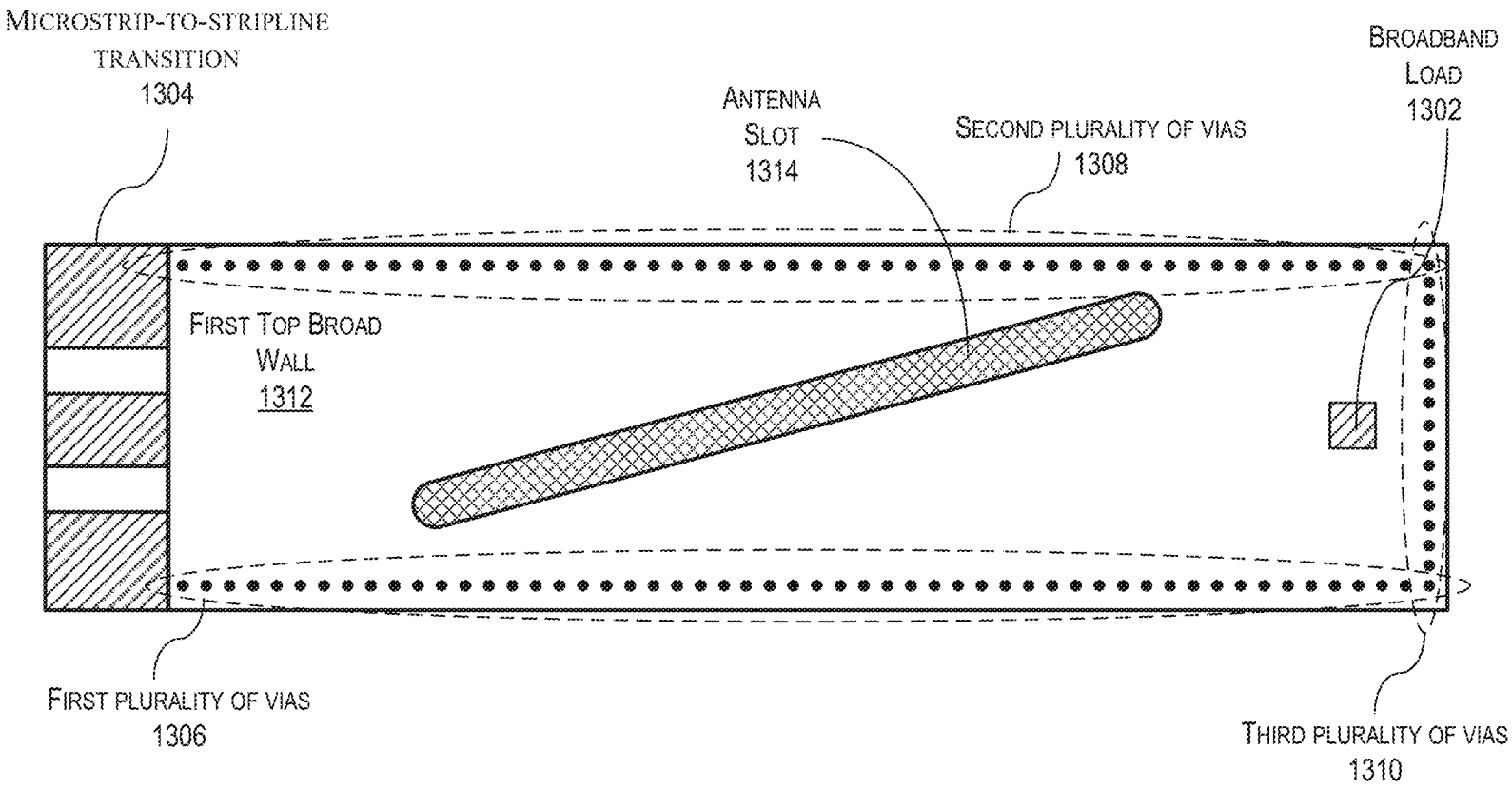
FIG. 13 is a top-view of an example of another implementation of a BCA 1300 utilizing the lamination process described in FIGS. 12A-12G in accordance with the present invention.

In FIG. 13, a top-view of an example implementation of a BCA 1300 utilizing the lamination process described in FIGS. 12A-12G is shown in accordance with the present invention. In this example, the BCA 1300 includes an integrated broadband load 1302 and has a microstrip-to-stripline transition ("MST") 1304. Additionally, in this example, the BCA 1300 includes a first plurality of vias 1306, a second plurality of vias 1308, and a third plurality of vias 1310 at the end of the first top broad wall 1312 of the BCA 1300 opposite from the MST 1302. As before, the BCA 1300 includes a first top broad wall 1312 and an antenna slot 1314 in the first top broad wall 1312.

Figure 14:
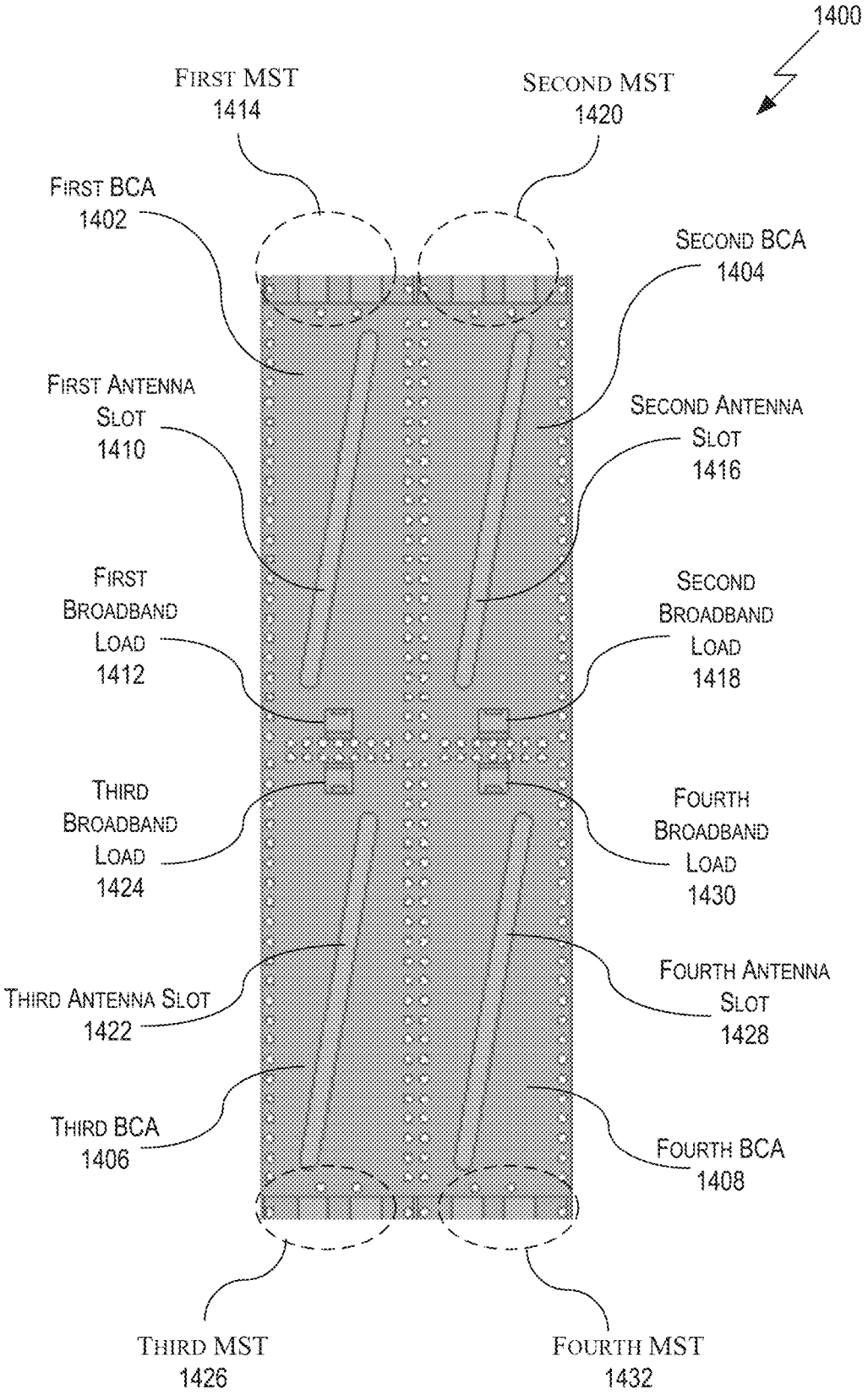
FIG. 14 is a top-view of an example of an implementation of a 2×2 antenna array utilizing the BCA shown in FIG. 13 in accordance with the present disclosure.

In FIG. 14, a top-view of an example of an implementation of a 2×2 antenna array 1400 utilizing the BCA of FIG. 13 is shown in accordance with the present disclosure. In this example, the 2×2 antenna array 1400 includes four BCAs 1402, 1404, 1406, and 1408. The first BCA 1402 includes a first antenna slot 1410, a first broadband load 1412, and a first MST 1414. The second BCA 1404 includes a second antenna slot 1416, a second broadband load 1418, and a second MST 1420. The third BCA 1406 includes a third antenna slot 1422, a third broadband load 1424, and a third MST 1426. Furthermore, the fourth BCA 1408 includes a fourth antenna slot 1428, a fourth broadband load 1430, and a fourth MST 1432.

Figure 15:
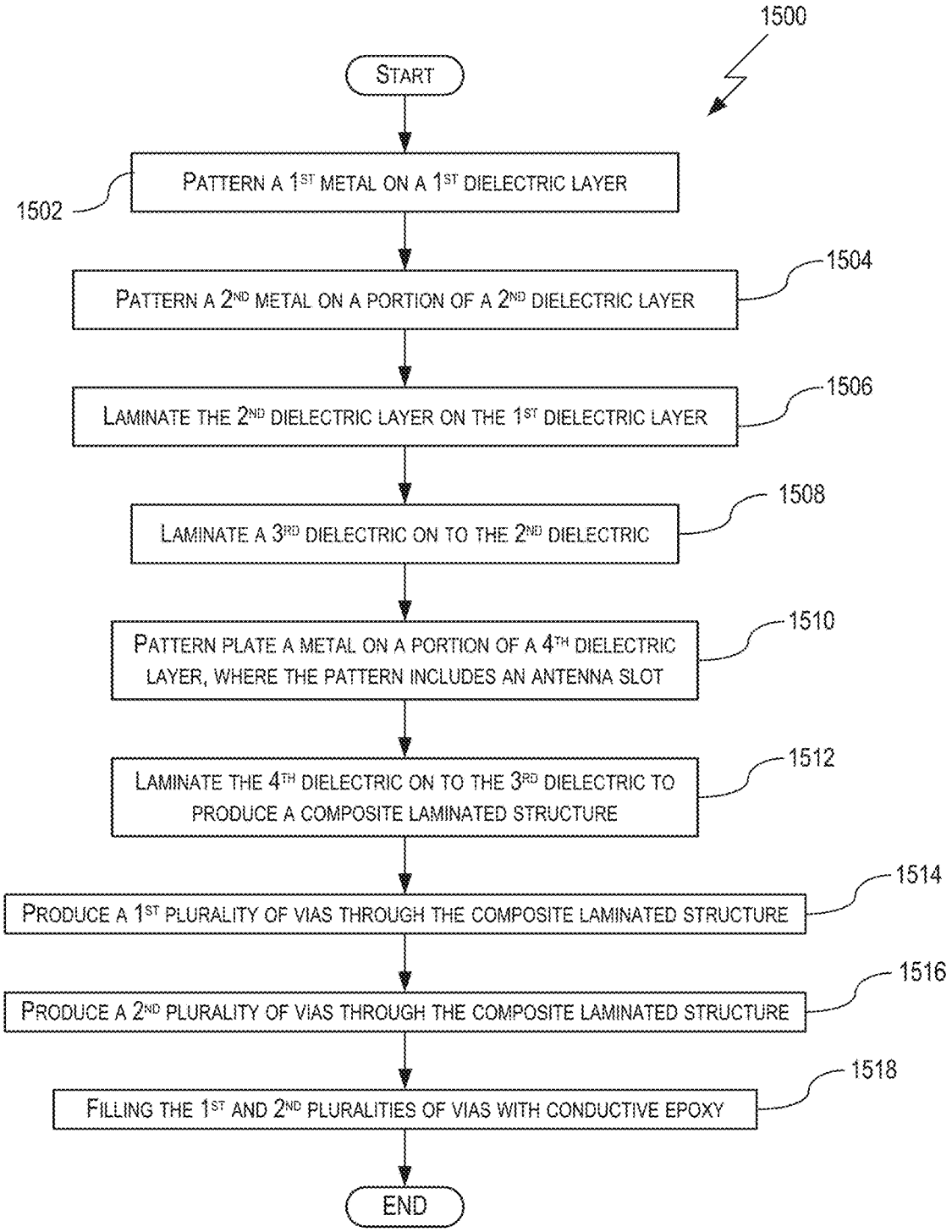
FIG. 15 is a flowchart of an example implementation of method for fabricating the BCA utilizing a lamination process in accordance with the present disclosure.

In FIG. 15, a flowchart is shown of an example implementation of method 1500 for fabricating the BCA utilizing a lamination process in accordance with the present disclosure.

The method 1500 is related to the stack up method for fabricating the BCA (i.e., either BCA 100, 700, 800, 1000, 1246, 1300, 1402, 1404, 1405, or 1408) utilizing the lamination process described in FIGS. 12A-12G.

The method 1500 starts by patterning 1502 a first metal 1208 on a first dielectric layer 1202 and patterning 1504 a second metal 1214 on a portion of a second dielectric layer 1202. The first dielectric layer 1202 has a top surface 1206 and a bottom surface 1208 and the first metal 1208 is patterned on the bottom surface 1208 of first dielectric layer 1202. The second dielectric layer 1212 also has a top surface 1216 and bottom surface 1218 and the second metal 1214 is patterned on a portion of the top surface 1216 of the second dielectric layer 1212. The method 1500 then includes laminating 1506 the bottom surface 1218 of the second dielectric layer 1212 on to the top surface 1206 of the first dielectric layer 1202 and laminating 1508 a third dielectric layer 1224 on to the second dielectric layer 1212. The third dielectric layer 1224 has a top surface 1226 and a bottom surface and the bottom surface of the third dielectric layer 1224 is laminated on to the top surface 1216 of the second dielectric layer 1212. The method 1500 then includes patterning 1510 a third metal 1234 on a fourth dielectric layer 1232. The fourth dielectric layer 1232 has a top surface 1236 and a bottom surface 1238. In this step, the third metal 1234 is patterned on the top surface 1236 of the fourth dielectric layer 1232 to produce a top broad wall 110, 704, 802, 806, 808, 1234, or 1312 and the third metal 1234 of the top broad wall 110, 704, 802, 806, 808, 1234, or 1312 is patterned to include an antenna slot 112, 804, 1240, 1314, 1410, 1416, 1422, or 1428 along the top broad wall 110, 704, 802, 806, 808, 1234, or 1312 that exposes the top surface 1236 of the fourth dielectric layer 1232 through the third metal 1234 of the top broad wall 110, 704, 802, 806, 808, 1234, or 1312. The method 1500 then includes laminating 1512 the bottom surface 1238 of the fourth dielectric layer 1232 on to the top surface 1226 of the third dielectric layer 1224 to produce a composite laminated structure 1242. The method 1500 further includes producing 1514 a first plurality of vias 1252 through a first side 1248 of the composite laminated structure 1242 and producing 1516 a second plurality of vias 1254 through a second side 1250 of the composite laminated structure 1242. The method 1500 then includes filling the first and second plurality of vias 1252 and 1254 with conductive material (such as, for example, conductive epoxy), where the conductive material in the first plurality of vias 1252 and second plurality of vias 1254 are in signal communication with the third metal 1234 that is patterned on the top surface 1236 of the fourth dielectric layer 1232 and the first metal 1204 that is patterned on the bottom surface 1208 of first dielectric layer 1202 causing the third metal 1234 and first metal 1204 to be electrically shorted. In the example, the first metal 1208, second metal 1214, and third metal 1234 are the same metal. The method 1500 then ends.

In this example, each of the first dielectric layer 1202, second dielectric layer 1212, third dielectric layer 1224, and the fourth dielectric layer 1232 may have a thickness that is approximately equal 10 mils. Additionally, the metal 1208, 1214, or 1234 that is patterned on the bottom surface 1208 of first dielectric layer 1202 and the top surface 1236 of the fourth dielectric layer may have a metal thickness that is approximately equal to 0.7 mils. As discussed earlier, the metal 1208, 1214, or 1234 may be a conductive material that includes non-metals and conductive metals such as, for example, copper, gold, silver, aluminum, steel.

In this example, at least one of the patterned first metal, second metal, or third metals may be formed by a subtractive method of pre-deposited electroplated or rolled metals, wherein the subtractive method includes wet etching or laser ablation. Alternatively, the one or more of the patterned first metal, second metal, or third metals are formed by an additive method that includes printing or deposition.

Additionally, in this example, the step of producing the first plurality of vias 1252 and second plurality of vias 1254 may include drilling, punching, or laser etching. Moreover, the step may include forming the first plurality of vias 1252 and second plurality of vias 1254 utilizing a subtractive method that includes wet etching or laser ablation, and forming the conductive material within the first plurality of vias and the second plurality of vias utilizing an additive method that includes printing or deposition.

In FIGS. 16A-16H, a stack up method for fabricating the BCA (i.e., either BCA 100, 700, or 800) utilizing an additive 3-D printing process is shown. Specifically, in FIG. 16A, a cross-sectional view of first section 1600 of the BCA is shown in accordance with the present disclosure. The first section 1600 of the BCA includes a first conductive layer 1602 with conductive ink that has a top surface 1604 and a first width 1606, where the first width 1606 has a first center 1608.

Figure 16A:
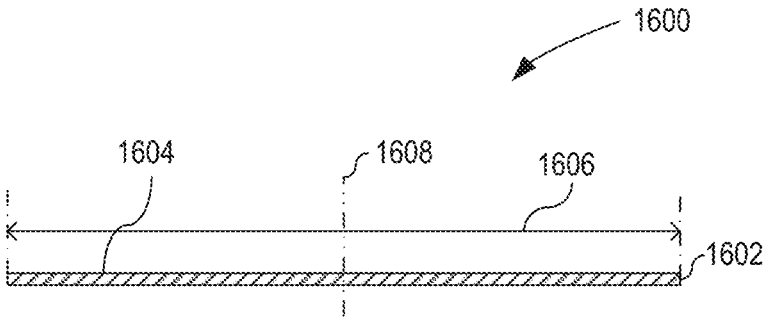
FIG. 16A is a cross-sectional view of another first section of the BCA in accordance with the present disclosure.
Figure 16B:
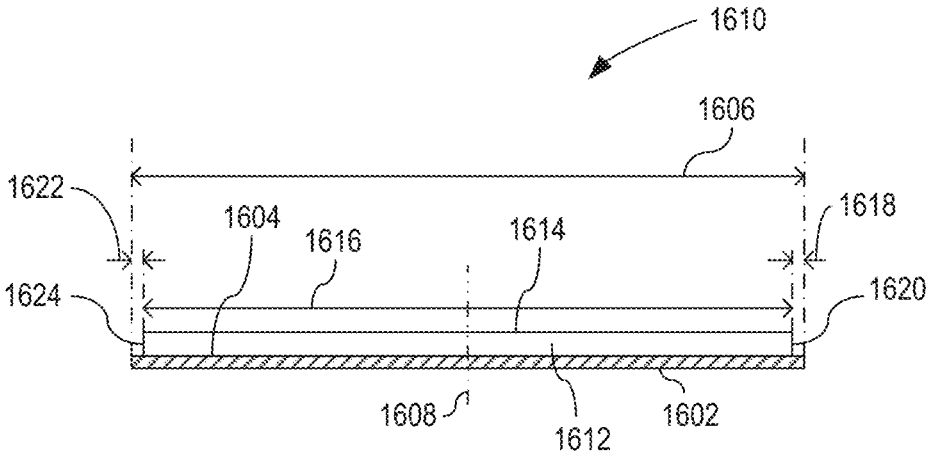
FIG. 16B is a cross-sectional view of a first combination of the first section and the printed first dielectric layer in accordance with the present disclosure.

In FIG. 16B, a cross-sectional view of a first combination 1610 of the first section 1600 and the printed first dielectric layer 1612 is shown in accordance with the present disclosure. In this example, the first dielectric layer 1612 is printed on the top surface 1604 of the first conductive layer 1602. The first dielectric layer has a top surface 1614 and a second width 1616, where the second width 1616 is less than the first width 1606. In this example, there is a first gap 1618 at a first end 1620 of the first dielectric layer 1612 and a second gap 1622 at a second end 1624 of the first dielectric layer 1612. The second width 1616 has a second center that is aligned with the first center 1608.

Figure 16C:
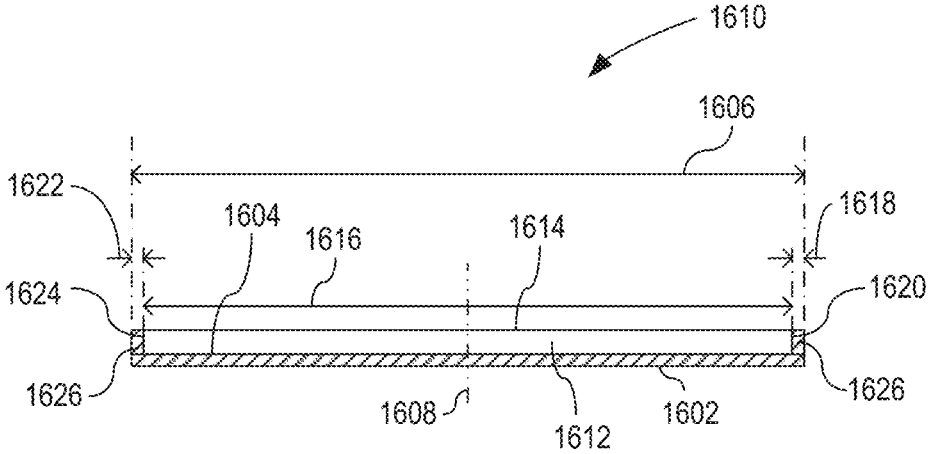
FIG. 16C is a cross-sectional view of the first combination with the first and second gaps filled with conductive ink in accordance with the present disclosure.

In FIG. 16C, a cross-sectional view of the first combination 1610 with the first and second gaps 1618 and 1622 with conductive ink 1626 is shown in accordance with the present disclosure. Specifically, a second conductive layer is printed with the conductive ink in the first and second gaps 1618 and 1622 of the first dielectric layer 1612.

Figure 16D:
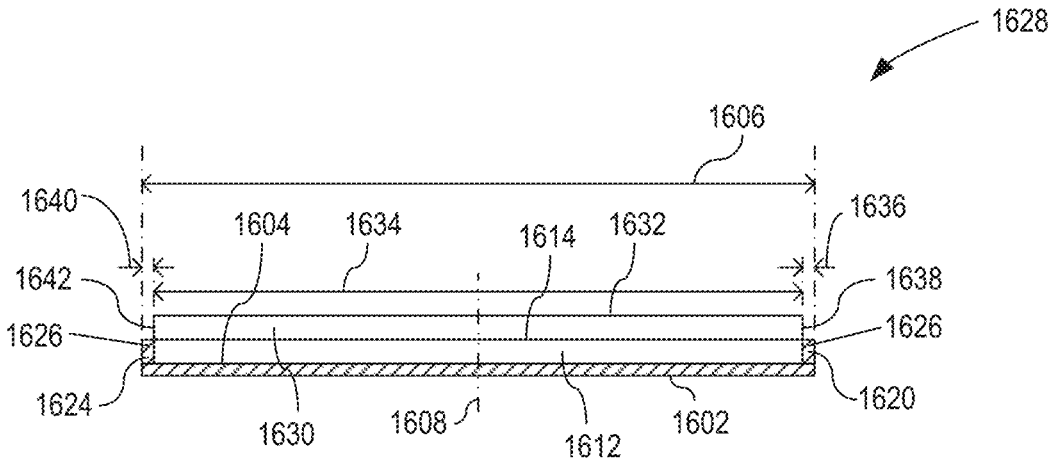
FIG. 16D is a cross-sectional view of a second combination of the first combination with filled first and second gaps and a second dielectric layer in accordance with the present disclosure.

In FIG. 16D, a cross-sectional view of a second combination 1628 of the first combination 1610 with first and second gaps 1618 and 1622 with conductive ink and a second dielectric layer 1630 is shown in accordance with the present disclosure. In this example, the second dielectric layer 1630 is printed on the top surface 1614 of the first dielectric layer 1612. The second dielectric layer 1630 has a top surface 1632 and a third width 1634, where the third width 1634 is less than the first width 1606. Similar to the first dielectric layer 1612, in this example, there is a first gap 1636 at a first end 1638 of the second dielectric layer 1630 and a second gap 1640 at a second end 1642 of the second dielectric layer 1630. The third width 1634 has a third center that is aligned with the first center 1608.

Figure 16E:
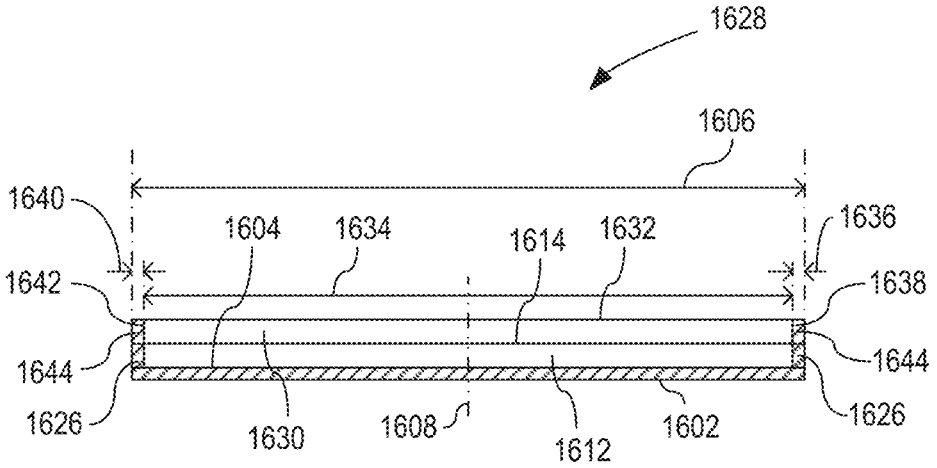
FIG. 16E is a cross-sectional view of the second combination with the first and second gaps filled with additional conductive ink in accordance with the present disclosure.

In FIG. 16E, a cross-sectional view of the second combination 1628 with the first and second gaps 1636 and 1640 with conductive ink 1644 is shown in accordance with the present disclosure. Specifically, a third conductive layer is printed with the conductive ink 1644 in the first and second gaps 1636 and 1640 of the second dielectric layer 1630.

Figure 16F:
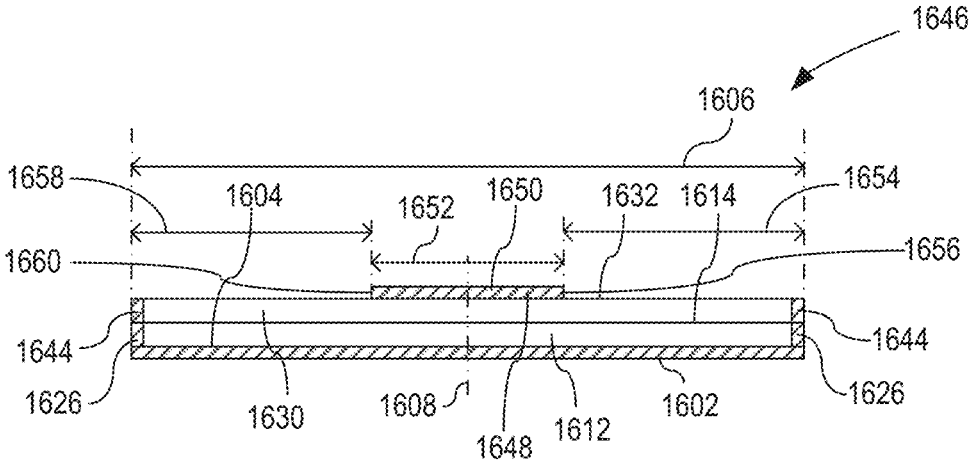
FIG. 16F is a cross-sectional view of a third combination of the second combination with filled first and second gaps and a fourth conductive layer in accordance with the present disclosure.

In FIG. 16F, a cross-sectional view of a third combination 1646 of the second combination 1628 with first and second gaps 1636 and 1640 with conductive ink 1644 and a fourth conductive layer 1648 is shown in accordance with the present disclosure. Specifically, the fourth conductive layer 1648 is printed on the top surface 1632 of the second dielectric layer 1630 with conductive ink. In this example, the fourth conductive layer 1648 has a top surface 1650 and a fourth width 1652, where the fourth width 1652 is less than the third width 1634. The fourth width 1634 results in a first gap 1654 at a first end 1656 of the fourth conductive layer 1648 and a second gap 1658 at a second end 1660 of the fourth conductive layer 1648. The fourth width 1652 has a fourth center that is aligned with the first center 1608.

Figure 16G:
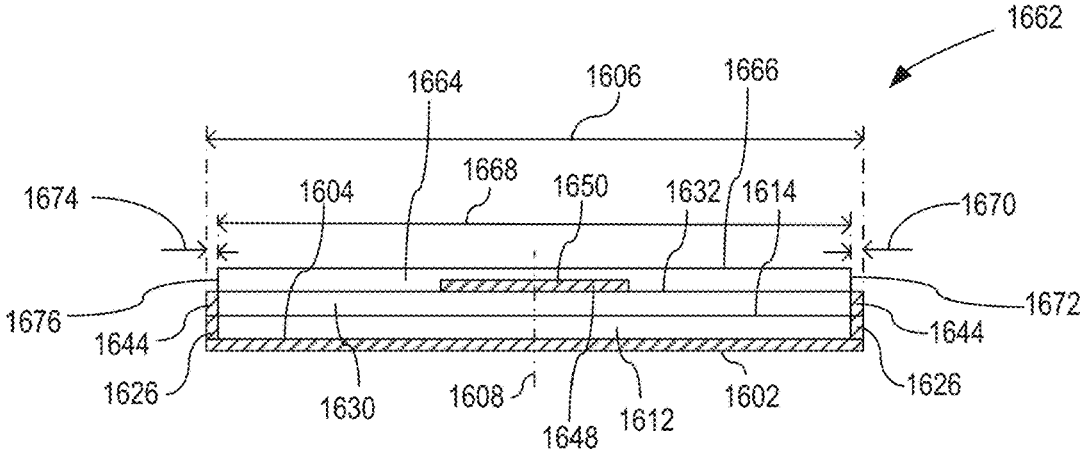
FIG. 16G is a cross-sectional view of a fourth combination of the third combination with a third dielectric layer in accordance with the present disclosure.

In FIG. 16G, a cross-sectional view of a fourth combination 1662 of the third combination 1646 with a third dielectric layer 1664 is shown in accordance with the present disclosure. Specifically, the third dielectric layer 1664 is printed on the top surface 1650 of the fourth conductive layer 1648 and the top surface 1632 of the second dielectric layer 1630. The third dielectric layer 1664 has a top surface 1666 and a fifth width 1668, where the fifth width 1668 is less than the first width 1606. Similar to the first and second dielectric layers 1612 and 1630, in this example, there is a first gap 1670 at a first end 1672 of the third dielectric layer 1664 and a second gap 1674 at a second end 1676 of the third dielectric layer 1664. The fifth width 1668 has a fifth center that is aligned with the first center 1608.

Figure 16H:
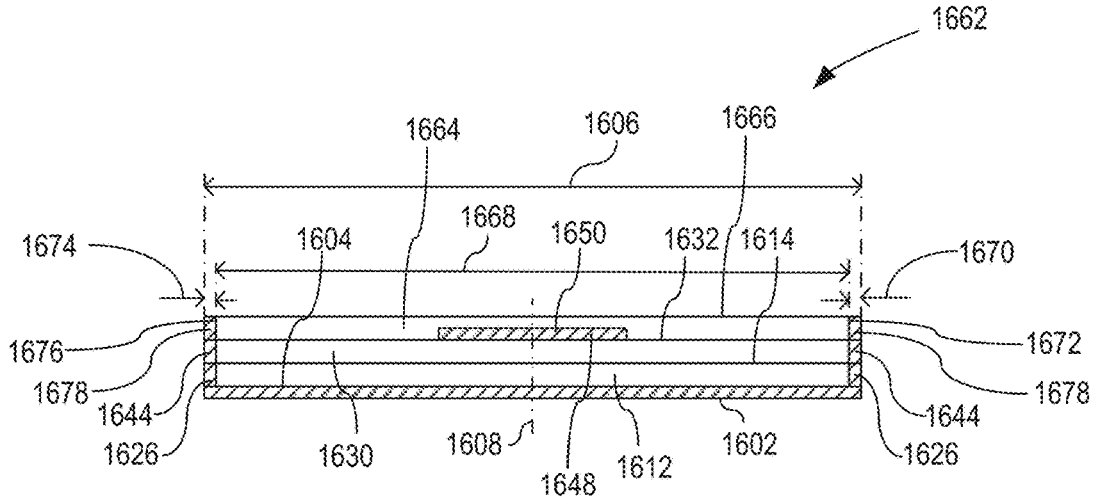
FIG. 16H is a cross-sectional view of the fourth combination with the first and second gaps filled with additional conductive ink in accordance with the present disclosure.

In FIG. 16H, a cross-sectional view of the fourth combination 1662 with first and second gaps 1670 and 1674 with conductive ink 1678 is shown in accordance with the present disclosure. Specifically, a fifth conductive layer is printed with conductive ink 1678 in the first and second gaps 1670 and 1674 of the third dielectric layer 1664.

Figure 16I:
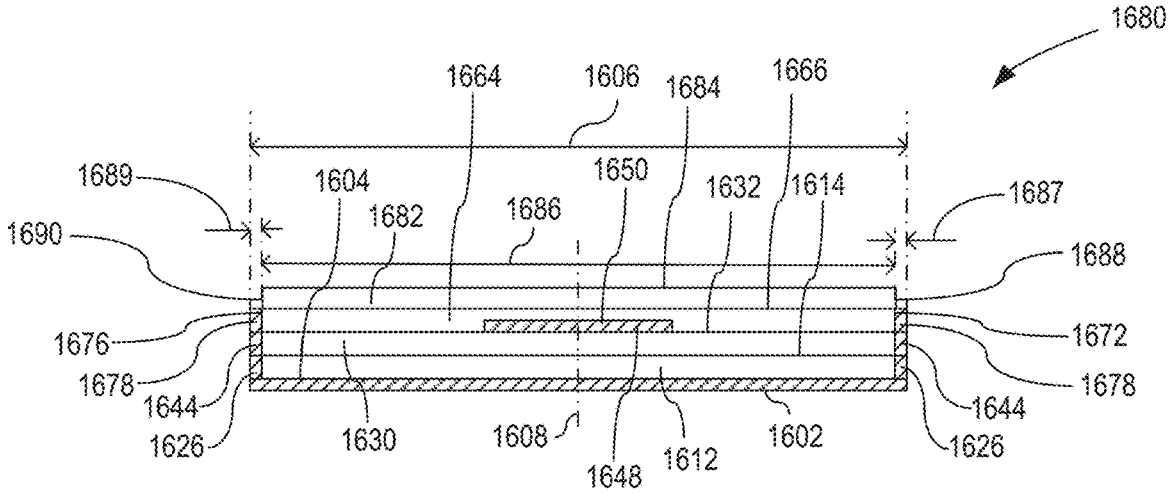
FIG. 16I is a cross-sectional view of a fifth combination of the fourth combination with a fourth dielectric layer in accordance with the present disclosure.

In FIG. 16I, a cross-sectional view of a fifth combination 1680 of the fourth combination 1662 with a fourth dielectric layer 1682 is shown in accordance with the present disclosure. In this example, the fourth dielectric layer 1682 is printed on the top surface 1666 of the third dielectric layer 1664. The fourth dielectric layer 1682 has a top surface 1684 and a sixth width 1686, where the sixth width 1686 is less than the first width 1606. Similar to the first dielectric layer 1612, in this example, there is a first gap 1687 at a first end 1688 of the fourth dielectric layer 1682 and a second gap 1689 at a second end 1690 of the fourth dielectric layer 1682. The sixth width 1686 has a sixth center that is aligned with the first center 1608.

Figure 16J:
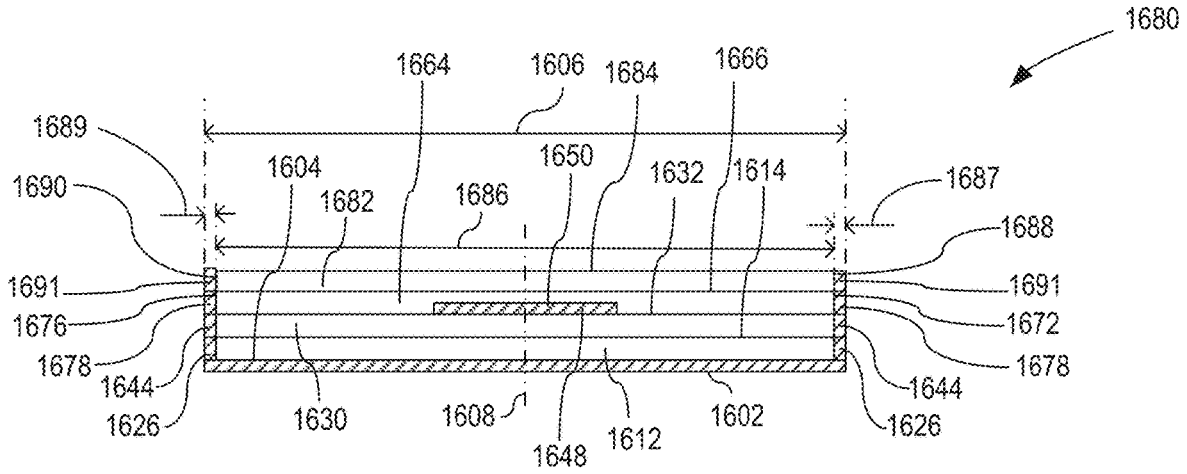
FIG. 16J is a cross-sectional view of the fifth combination with the first and second gaps filled with conductive ink in accordance with the present disclosure.

In FIG. 16J, a cross-sectional view of the fifth combination 1680 with the first and second gaps 1687 and 1689 with conductive ink 1691 is shown in accordance with the present disclosure. Specifically, a sixth conductive layer is printed with the conductive ink 1691 in the first and second gaps 1687 and 1689 of the fourth dielectric layer 1682.

Figure 16K:
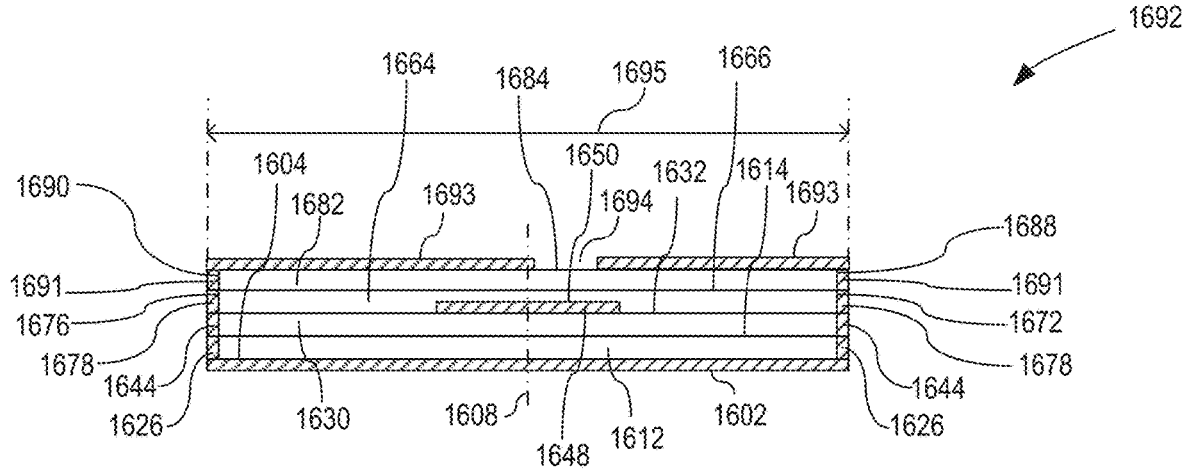
FIG. 16K is a cross-sectional view of a sixth combination of the fifth combination with the first and second gaps filled with conductive ink and a seventh conductive layer in accordance with present disclosure.

In FIG. 16K, a cross-sectional view of a sixth combination 1692 of the fifth combination 1680 with first and second gaps 1687 and 1689 with conductive ink 1691 and a seventh conductive layer 1693 is shown in accordance with the present disclosure. Specifically, the seventh conductive layer 1693 is printed on the top surface 1684 of the fourth dielectric layer 1682 with conductive ink. The seventh conductive layer 1693 includes an antenna slot 1694 along the seventh conductive layer 1693 (i.e., top broad wall). In this example, the seventh conductive layer 1693 has seventh width 1695 that is approximately equal to the first width 1606.

In these examples, each of the first dielectric pattern 1612, second dielectric pattern 1630, third dielectric pattern 1664, and fourth dielectric patterns 1682 may have a thickness that is approximately equal 10 mils. The first and seventh conductive layers may have a thickness that is approximately equal to 0.7 mils. Also as discussed previously, the conductive ink may be a conductive material that may be utilized by a 3-D printing process.

Figure 17:
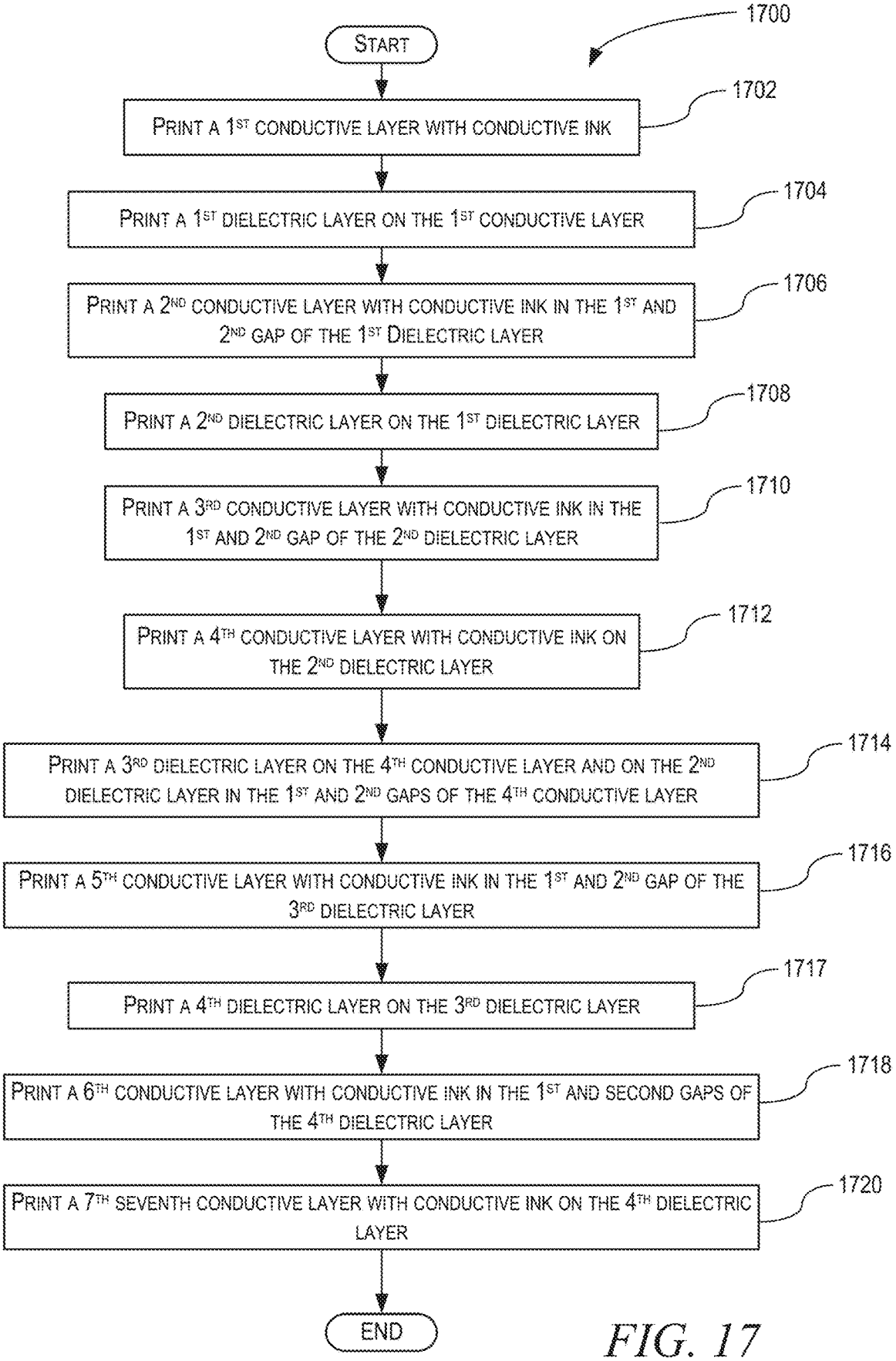
FIG. 17 is a flowchart of an example implementation of method for fabricating the BCA utilizing an additive printing process in accordance with the present disclosure.

In FIG. 17, a flowchart is shown of an example implementation of method 1700 for fabricating the BCA (i.e., either BCA 100, 700, 800, 1000, or 1692) utilizing a 3-D additive printing process in accordance with the present disclosure. The method 1700 is related to the stack up method for fabricating the BCA (i.e., either BCA 100, 700, 800, 1000, or 1692) utilizing the additive 3-D printing process is shown in FIGS. 16A-16K.

The method 1700 starts by printing 1702 a first conductive layer 1602 with conductive ink having a top surface 1604 and a first width 1606, where the first width 1606 has a first center 1608 and printing 1704 a first dielectric layer 1612 on the top surface 1604 of the first conductive layer 1602. In this example, the first dielectric layer 1612 has a top surface 1614 and a second width 1616, the second width 1616 is less than the first width 1606, and there is a first gap 1618 at a first end 1620 of the first dielectric layer 1612 and a second gap 1622 at a second end 1624 of the first dielectric layer 1612. The method 1700 then prints 1706 a second conductive layer 1626 with conductive ink in the first gap 1618 and second gap 1622 of the first dielectric layer 1612 and prints 1708 a second dielectric layer 1630 on the top surface 1614 of the first dielectric layer 1612. In this example, the second dielectric layer 1630 has a top surface 1632 and a third width 1634 and there is a first gap 1636 at a first end 1638 of the second dielectric layer 1630 and a second gap 1640 at a second end 1642 of the second dielectric layer 1630. The method 1700 then prints 1710 a third conductive layer 1644 with conductive ink in the first gap 1636 and second gap 1640 of the second dielectric layer 1630 and prints 1712 a fourth conductive layer 1648 with conductive ink on the top surface 1632 of the second dielectric layer 1630. In this example, the fourth conductive layer 1648 has a top surface 1650 and a fourth width 1652, the fourth width 1652 is less than the third width 1634, and there is a first gap 1654 at a first end 1656 of the fourth conductive layer 1648 and a second gap 1658 at a second end 1660 of the fourth conductive layer 1654. The method 1700 then prints 1714 a third dielectric layer 1664 on the top surface 1650 of the fourth conductive layer 1648 and on the top surface 1632 on the second dielectric layer 1630 in the first gap 1654 and second gap 1658 of the fourth conductive layer 1648. The third dielectric layer 1664 has a top surface 1666 and a fifth width 1668 and there is a first gap 1670 at a first end 1672 of the third dielectric layer 1664 and a second gap 1674 at a second end 1676 of the third dielectric layer 1664. The method 1700 then prints 1716 a fifth conductive layer 1678 with conductive ink in the first gap 1670 and second gap 1674 of the third dielectric layer 1664 and prints 1717 a fourth dielectric layer 1682 on the top surface 1666 of the third dielectric layer 1664. The fourth dielectric layer 1682 has a top surface 1684 and a sixth width 1686 and there is a first gap 1687 at a first end 1688 of the fourth dielectric layer 1682 and a second gap 1689 at a second end 1690 of the fourth dielectric layer 1682. The method 1700 then prints 1718 a sixth conductive layer 1691 with conductive ink in the first gap 1687 and second gap 1689 of the fourth dielectric layer 1682 and prints 1720 a seventh conductive layer 1693 with conductive ink on the top surface 1684 of the fourth dielectric layer 1682. In this example, the seventh conductive layer 1693 includes an antenna slot 112, 804, or 1694 along the seventh conductive layer 1693 that exposes the top surface 1684 of the fourth dielectric layer 1682 through the seventh conductive layer 1693. The method 1700 then ends.

It will be understood that various aspects or details of the invention may be changed without departing from the scope of the invention. It is not exhaustive and does not limit the claimed inventions to the precise form disclosed. Furthermore, the foregoing description is for the purpose of illustration only, and not for the purpose of limitation. Modifications and variations are possible in light of the above description or may be acquired from practicing the invention. The claims and their equivalents define the scope of the invention.

In some alternative examples of implementations, the function or functions noted in the blocks may occur out of the order noted in the figures. For example, in some cases, two blocks shown in succession may be executed substantially concurrently, or the blocks may sometimes be performed in the reverse order, depending upon the functionality involved. Also, other blocks may be added in addition to the illustrated blocks in a flowchart or block diagram.

The description of the different examples of implementations has been presented for purposes of illustration and description, and is not intended to be exhaustive or limited to the examples in the form disclosed. Many modifications and variations will be apparent to those of ordinary skill in the art. Further, different examples of implementations may provide different features as compared to other desirable examples. The example, or examples, selected are chosen and described in order to best explain the principles of the examples, the practical application, and to enable others of ordinary skill in the art to understand the disclosure for various examples with various modifications as are suited to the particular use contemplated.

What is claimed is:

1. A broadband conformal antenna ("BCA") comprising:

a narrow approximately rectangular outer conductive ("NARO") housing, wherein the NARO housing includes a top broad wall and a bottom broad wall, each of the top broad wall and the bottom broad wall having a length, the top broad wall connected to the bottom broad wall by a pair of narrow walls, each narrow wall having a narrow wall height, and the NARO housing including a first end located the length away from a second end, wherein the top broad wall is constructed of copper, has a thickness approximately equal to 0.7 mils, a width approximately equal to 82.8 mils, and a length approximately equal to 1181 mils;

a plurality of dielectric layers within the NARO housing forming a laminated dielectric structure, wherein each dielectric layer of the plurality of dielectric layers has a thickness approximately equal to 10 mils;

an inner stripline conductor formed within the laminated dielectric structure, the inner stripline conductor extending the length from the first end to the second end; and an antenna slot within the top broad wall, wherein the NARO housing supports a transverse electromagnetic signal during use, and wherein the antenna slot is angled and centered along the top broad wall.

2. The BCA of claim 1, further comprising a broadband load coupled to the inner stripline conductor and the NARO housing.

3. The BCA of claim 2, wherein the BCA has a characteristic impedance and wherein the broadband load has an impedance that is substantially the characteristic impedance of the BCA.

4. The BCA of claim 3, wherein the impedance of the broadband load is approximately 50 ohms.

5. The BCA of claim 1, wherein the bottom broad wall is contoured to conform to a curved surface of an object.

6. The BCA of claim 5, further comprising one or more fasteners configured to couple the bottom broad wall to the curved surface.

7. The BCA of claim 6, wherein the one or more fasteners comprise an adhesive.

8. The BCA of claim 6, wherein the one or more fasteners comprises a first strip coupled to the bottom broad wall, a second strip coupled to the curved surface, wherein the first strip comprises a plurality of hooks configured to couple to a plurality of loops of the second strip or wherein the first strip comprises a plurality of loops configured to couple to a plurality of hooks of the second strip.

9. The BCA of claim 1, further comprising one or more fasteners configured to couple the bottom broad wall to a flat surface of an object.

10. The BCA of claim 9, wherein the one or more fasteners comprise magnets.

11. The BCA of claim 9, wherein the one or more fasteners comprise screws or rivets.

12. The BCA of claim 1, wherein the top broad wall has a broad wall width, and wherein the broad wall width is approximately twice the narrow wall height.

13. The BCA of claim 12, wherein the inner stripline conductor is located at a first position within the NARO housing that is approximately at a first center position that is equal to half of the narrow wall height and wherein the inner stripline conductor has an inner conductor center that is located at a second position within the NARO housing that is approximately at a second center position that is equal to half of the broad wall width.

14. The BCA of claim 1, wherein the inner stripline conductor is coupled to a ground.

15. The BCA of claim 14, wherein a first narrow wall of the pair of narrow walls is formed by a first plurality of vias from the top broad wall to the bottom broad wall, and wherein a second narrow wall of the pair of narrow walls is formed by a second plurality of vias from the top broad wall and the bottom broad wall.

16. The BCA of claim 15, wherein the first plurality of vias electrically connect the top broad wall to the bottom broad wall, and wherein the second plurality of vias electrically connect the top broad wall to the bottom broad wall.

17. The BCA of claim 16, wherein the first plurality of vias and the second plurality of vias are filled with conductive epoxy.

18. The BCA of claim 1, further including a second antenna slot within the top broad wall.

19. The BCA of claim 1, further including a power divider in signal communication with an input port of the NARO housing.

20. A method for fabricating a broadband conformal antenna ("BCA") utilizing a lamination process, the method comprising:

patterning a first metal on a first dielectric layer, the first dielectric layer having a top surface, a bottom surface, and a dielectric layer thickness of approximately 10 mils, wherein the first metal is patterned on the bottom surface of the first dielectric layer to produce a bottom broad wall having a length of approximately 1181 mils;

patterning a second metal on a second dielectric layer, the second dielectric layer having a top surface, a bottom surface, and the dielectric layer thickness, wherein the second metal is patterned on a portion of the top surface of the second dielectric layer, and wherein the second metal is patterned on the second dielectric layer to produce an inner stripline conductor;

laminating the bottom surface of the second dielectric layer on the top surface of the first dielectric layer;

laminating a third dielectric layer, the third dielectric layer having a top surface, a bottom surface, and the dielectric layer thickness, on the second dielectric layer, wherein the bottom surface of the third dielectric layer is laminated on to the top surface of the second dielectric layer;

patterning copper on a fourth dielectric layer, the fourth dielectric layer having a top surface, a bottom surface, and the dielectric layer thickness, wherein the copper has a thickness of approximately 0.7 mils, a width of approximately 82.8 mils, and is patterned on the top surface of the fourth dielectric layer to produce a top broad wall having the length, wherein the copper of the top broad wall is patterned to include an antenna slot along the top broad wall that exposes the top surface of the fourth dielectric layer through the copper of the top broad wall, and wherein the antenna slot is angled and centered along the top broad wall;

laminating the bottom surface of the fourth dielectric layer on the top surface of the third dielectric layer to produce a composite laminated structure; and electrically shorting the first metal to the copper by a pair of narrow walls, each narrow wall having a narrow wall height, wherein the first metal, the pair of narrow walls, and the copper comprise portions of a narrow approximately rectangular outer conductive ("NARO") housing having a first end located the length away from a second end, wherein the inner stripline conductor extends the length from the first end to the second end, and wherein the NARO housing supports a transverse electromagnetic signal during use.

21. The method of claim 20, wherein one or more of the first metal, the second metal, and the copper are formed by a subtractive method of pre-deposited electroplated or rolled metals, wherein the subtractive method includes wet etching or laser ablation.

22. The method of claim 20, wherein one or more of the first metal, the second metal, and the copper are formed by an additive method that includes printing or deposition.

23. The method of claim 20, wherein the electrically shorting the first metal to the copper comprises:

producing a first plurality of vias through a first side of the composite laminated structure;

producing a second plurality of vias through a second side of the composite laminated structure; and filling the first plurality of vias and the second plurality of vias with a conductive material, wherein the conductive material in the first and second plurality of vias is coupled for signal communication with the copper that is plated on the top surface of the fourth dielectric layer and the first metal that is plated on the bottom surface of the first dielectric layer, and wherein the first metal and the second metal are a particular metal.

24. The method of claim 23, wherein the producing the first plurality of vias and the producing the second plurality of vias comprises laser etching, punching, or forming the first plurality of vias and the second plurality of vias, wherein the forming the first plurality of vias and the second plurality of vias includes utilizing a subtractive method that includes wet etching or laser ablation, and wherein the filling the first plurality of vias and the second plurality of vias includes forming the conductive material within the first plurality of vias and the second plurality of vias utilizing an additive method that includes printing or deposition.

25. The method of claim 23, wherein the particular metal is copper.

26. The method of claim 20, further comprising coupling a broadband load to the NARO housing and to the inner stripline conductor.

27. The method of claim 26, wherein the BCA has a characteristic impedance and wherein the broadband load has an impedance that is substantially the characteristic impedance of the BCA.

28. The method of claim 27, wherein the impedance of the broadband load is approximately 50 ohms.

29. A broadband conformal antenna comprising:

a narrow approximately rectangular outer conductive ("NARO") housing, wherein the NARO housing includes a top horizontal wall and a bottom horizontal wall, each of the top horizontal wall and the bottom horizontal wall having a length, the top horizontal wall electrically connected to the bottom horizontal wall by a first vertical wall and a second vertical wall, each of the first vertical wall and the second vertical wall having a vertical wall height, and the NARO housing including a first end located the length away from a second end, wherein the top horizontal wall has a horizontal wall width, wherein the horizontal wall width is approximately twice the vertical wall height, wherein the first vertical wall comprises a plurality of first vias extending from an edge of the top horizontal wall to an edge of the bottom horizontal wall, and wherein the second vertical wall comprises a plurality of second vias extending from an opposite edge of the top horizontal wall to an opposite edge of the bottom horizontal wall;

a plurality of dielectric layers within the NARO housing forming a laminated dielectric structure;

an inner conductor formed within the laminated dielectric structure, wherein the inner conductor extends the length from the first end to the second end, wherein a central longitudinal axis of the inner conductor is located at a first position within the NARO housing approximately equal to half of the vertical wall height and a second position within the NARO housing approximately equal to half of the horizontal wall width; and a plurality of slanted antenna slots within the top horizontal wall, wherein the NARO housing supports a transverse electromagnetic signal during use.

30. The broadband conformal antenna of claim 29, further comprising a broadband load coupled to the inner conductor and the NARO housing.

31. The broadband conformal antenna of claim 29, further comprising one or more fasteners configured to couple the bottom horizontal wall to a surface of an object.

32. The broadband conformal antenna of claim 31, wherein the one or more fasteners comprises an adhesive.

33. The broadband conformal antenna of claim 29, wherein the NARO housing is configured to be flexible to conform and couple to a curved surface of an object.

* * * * *